US009027523B2

(12) United States Patent
Morishima et al.

(10) Patent No.: US 9,027,523 B2
(45) Date of Patent: May 12, 2015

(54) LASER IGNITION APPARATUS

(71) Applicants: Nippon Soken, Inc., Nishio, Aichi-pref. (JP); Denso Corporation, Kariya, Aichi-pref. (JP)

(72) Inventors: Shingo Morishima, Toyota (JP); Kenji Kanehara, Toyohashi (JP); Yuya Abe, Kariya (JP); Akimitsu Sugiura, Nagoya (JP)

(73) Assignees: Nippon Soken, Inc., Nishio-shi (JP); Denso Corporation, Kariya (JP)

( * ) Notice: Subject to any disclaimer, the term of this patent is extended or adjusted under 35 U.S.C. 154(b) by 400 days.

(21) Appl. No.: 13/671,306

(22) Filed: Nov. 7, 2012

(65) Prior Publication Data

US 2013/0112164 A1 May 9, 2013

(30) Foreign Application Priority Data

Nov. 7, 2011 (JP) ..... 2011-243286

(51) Int. Cl.
*F02P 23/04* (2006.01)

(52) U.S. Cl.
CPC ..... *F02P 23/04* (2013.01)

(58) Field of Classification Search
CPC ..... F02P 23/04
USPC ..... 123/143 B
See application file for complete search history.

(56) References Cited

U.S. PATENT DOCUMENTS

| | | | | |
|---|---|---|---|---|
| 7,499,477 | B2 * | 3/2009 | Winklhofer et al. | 372/10 |
| 2007/0064746 | A1 | 3/2007 | Winklhofer et al. | |
| 2010/0263615 | A1 | 10/2010 | Weinrotter et al. | |
| 2012/0180744 | A1 * | 7/2012 | Gruber et al. | 123/169 R |
| 2012/0210969 | A1 * | 8/2012 | Gruber et al. | 123/143 B |
| 2013/0186361 | A1 * | 7/2013 | Nuebel et al. | 123/143 B |
| 2013/0186362 | A1 * | 7/2013 | Kanehara et al. | 123/143 B |
| 2013/0206091 | A1 * | 8/2013 | Kanehara et al. | 123/143 B |

FOREIGN PATENT DOCUMENTS

| | | |
|---|---|---|
| JP | A-08-165978 | 6/1996 |
| JP | A-2006-220091 | 8/2006 |
| JP | A-2007-506031 | 3/2007 |
| JP | A-2009-194076 | 8/2009 |
| JP | A-2010-537119 | 12/2010 |
| WO | WO 2005/028856 A1 | 3/2005 |
| WO | WO 2009/027145 A1 | 3/2009 |

* cited by examiner

*Primary Examiner* — Hai Huynh
(74) *Attorney, Agent, or Firm* — Oliff PLC

(57) ABSTRACT

A laser ignition apparatus includes a housing that has a male-threaded portion for fixing the housing and a hexagonal portion for tightening the male-threaded portion. Between a combustion chamber-side end of the male-threaded portion and an anti-combustion chamber-side end of the hexagonal portion, there is defined a non-optical element arrangement region in which none of an introducing optical element, an enlarging optical element and a focusing optical element of the apparatus is arranged. At one of a combustion chamber-side end and an anti-combustion chamber-side end of the non-optical element arrangement region, there is formed a reference surface that extends perpendicular to an axial direction of the housing. One of the introducing optical element, the enlarging optical element and the focusing optical element is received in the housing in such a manner as to be elastically pressed against the reference surface from outside of the non-optical element arrangement region.

16 Claims, 11 Drawing Sheets

(a) FIRST EMBODIMENT (b) COMPARATIVE EXAMPLE

LASER IGNITION APPARATUS

CROSS-REFERENCE TO RELATED APPLICATION

This application is based on and claims priority from Japanese Patent Application No. 2011-243286, filed on Nov. 7, 2011, the content of which is hereby incorporated by reference in its entirety into this application.

BACKGROUND

1. Technical Field

The present invention relates to a laser ignition apparatus for ignition of an internal combustion engine that is installed in a limited installation space in, for example, a motor vehicle.

2. Description of Related Art

In recent years, various laser ignition apparatuses have been proposed for ignition of internal combustion engines that are difficult to be ignited; those engines include, for example, highly-charged engines, high-compression engines, and natural gas engines with large inner diameters of cylinders. The laser ignition apparatuses are generally configured to: (1) irradiate an excitation light generated by an excitation light source (e.g., a flash lamp or a semiconductor laser) to a laser resonator (or optical resonator) that includes a laser medium and a Q switch, thereby causing the resonator to generate a pulsed laser light that has a short pulse width and a high energy density; and (2) focusing the pulsed laser light, using an optical element (e.g., a focusing lens), to a focal point (or an ignition point) in a combustion chamber of the engine to generate a flame kernel that has a high energy density, thereby igniting the air-fuel mixture in the combustion chamber.

For example, Japanese Unexamined Patent Application Publication No. 2006-220091 (to be simply referred to as Patent Document 1 hereinafter) discloses a laser-ignited engine. The engine includes both a solid target provided on the upper surface of a piston of the engine so as to face a combustion chamber of the engine and a gas target provided in the combustion chamber. The engine also includes a controller that sets the irradiating timing of a laser beam to a predetermined timing during a start or a low-load operation of the engine.

Japanese Unexamined Patent Application Publication No. 2007-506031 (to be simply referred to as Patent Document 2 hereinafter) discloses an internal combustion engine that is equipped with a laser ignition apparatus. The laser ignition apparatus includes a pumping light source, a laser resonator that includes a solid laser crystal to produce a laser beam, a Q switch for increasing the energy density of the laser beam, at least one output mirror, and a focusing device for focusing the laser beam into a combustion chamber of the engine. In addition, Patent Document 2 has an English equivalent the publication number of which is U.S. 2007/0064746 A1.

Japanese Unexamined Patent Application Publication No. 2010-537119 (to be simply referred to as Patent Document 3 hereinafter) discloses a laser ignition apparatus that includes a laser-active solid, a combustion chamber window, and a tubular housing. The combustion chamber window is connected to the housing in a gas-tight, pressure-resistant and temperature-resistant manner. In addition, Patent Document 3 has an English equivalent the publication number of which is U.S. 2010/0263615 A1.

Moreover, as shown in FIG. 1 of Patent Document 1 and FIG. 6 of Patent Document 2, the existing laser ignition apparatuses generally have the optical elements (e.g., a focusing lens and an enlarging lens) disposed in a tubular housing (or casing), and the housing is fixed to the cylinder head of the engine by tightening a male-threaded portion of the housing into a female-threaded hole formed in the cylinder head.

Therefore, during the tightening of the male-threaded portion of the housing into the female-threaded hole of the cylinder head, torsion of the housing may be caused by the tightening torque, thereby inducing mechanical stresses in the optical elements received in the housing. Consequently, due to the mechanical stresses, the optical axes of the optical elements may be distorted, thereby causing problems such as making it difficult to focus the laser beam to a desired ignition point and resulting in variation in the reflectance of the incident light and thus in variation in the output energy. As a result, the ignition of the air-fuel mixture by the laser ignition apparatus may become unstable.

Further, in the case of the laser-ignited engine disclosed in the Patent Document 1, the pulsed laser light generated by the laser resonator, which is located outside of the housing, is first transmitted to the focusing lens via an optical fiber. Then, the focusing lens, which is arranged in the housing, focuses the pulsed laser light into the combustion chamber of the engine. In this case, since only the focusing lens and an optical window member for protecting the focusing lens are received in the housing, it is possible to simplify the structure of the housing, thereby facilitating the mounting of the housing to the cylinder head. However, on the other hand, the energy loss incurred during the transmission of the pulsed laser light via the optical fiber may be so large as to cause the ignition of the air-fuel mixture to become unstable.

In the case of the laser ignition apparatus disclosed in the Patent Document 2, the pumping diodes, which together make up the pumping light source, are arranged so as to surround the outer periphery of the columnar solid laser crystal that is included in the laser resonator. The pumping diodes irradiate the excitation light to the side surface of the solid laser crystal, thereby causing the pulsed laser light to be outputted in the direction of a longitudinal axis of the solid laser crystal. Therefore, in this case, the radial size of the laser resonator may be considerably larger than that in the case of irradiating the excitation light to that end face of the solid laser crystal which is on the proximal side (i.e., on the opposite side to the combustion chamber) in the direction of the longitudinal axis of the solid laser crystal.

In addition, to cool the solid laser crystal, a cooling device, which is comprised of Peltier cooling elements and two liquid cooling circulation systems, is further provided around the pumping diodes. As a result, as shown in FIG. 1 of Patent Document 2, at the proximal-side end of the elongated tubular housing, there is formed a solid laser unit that has a very large radial size. Accordingly, when there is only a limited installation space above the cylinder head, it may be difficult to mount the laser ignition apparatus to the cylinder head.

In particular, in recent years, there is a tendency of minimizing the diameters of plug holes (i.e., the through-holes formed in cylinder heads of engines for mounting spark plugs to the cylinder heads). Thus, there is also a demand for minimizing the sizes of spark plugs.

Accordingly, it is also required to minimize the sizes of laser ignition apparatuses. However, with the configuration of the laser ignition apparatus disclosed in Patent Document 2, it is difficult to meet the above requirement.

In addition, with the large solid laser unit formed at the proximal end of the elongated tubular hosing, when an external vibration or shock is transmitted to the laser ignition apparatus, the moment of inertia loaded on the housing will be large. Consequently, the optical axis connecting the solid laser unit and the focusing lens may be distorted, thereby making it impossible to focus the pulsed laser light to a suitable ignition point in the combustion chamber and thus causing the ignition of the air-fuel mixture to become unstable.

In the case of the laser ignition apparatus disclosed in Patent Document 3, the tubular housing has both a laser resonator and a focusing lens received therein. The laser resonator is comprised of an input mirror, the laser-active solid, a Q switch and an output mirror. On the other hand, the pumping light source (or excitation light source) is located outside of the housing. When the pumping light (or excitation light) generated by the pumping light source is irradiated to the laser resonator from the proximal side, the temperature of the laser-active solid will be increased, thereby varying the cycle of the pulsed laser light generated by the laser resonator. In addition, due to the difference in coefficient of thermal expansion between the housing and the laser-active solid, tensile stress or compressive stress will be induced in the laser-active solid, thereby distorting the optical axis of the pulsed laser light. As a result, it may become impossible to focus the pulsed laser light to a suitable ignition point in the combustion chamber, causing the ignition of the air-fuel mixture to become unstable.

Further, as shown in FIG. 2 of Patent Document 3, to separate all the components received in the housing from the combustion chamber, the combustion chamber window, which is made of a heat-resistant glass, is joined to a distal-side end face (i.e., a combustion chamber-side end face) of the metallic housing by, for example, soldering or a ceramic adhesive. However, the joint formed between the combustion chamber window and the housing is located inside the combustion chamber and thus directly exposed to the air-fuel mixture whose pressure and temperature change greatly. Therefore, even if the differences in coefficient of thermal expansion between the housing, the combustion chamber window and the joining material are made small and a surface-active material is used therebetween, it is still possible for the joining material to peel off from the housing and the combustion chamber window due to age-related deterioration. Consequently, the combustion chamber window may be detached from the housing to fall into the combustion chamber, thereby damaging the engine. That is to say, the laser ignition apparatus may lack reliability.

In addition, in another embodiment of Patent Document 3, the housing has a two-part structure consisting of an inner shell and an outer shell. The outer shell has a projection formed at a distal-side end thereof. The combustion chamber window, which is substantially flat plate-shaped, has its outer peripheral portion retained between the inner shell and the projection of the outer shell (see FIG. 3 of Patent Document 3). Consequently, the combustion chamber window can be prevented from being detached from the housing and thus from falling into the combustion chamber. However, in this case, the combustion chamber window is inevitably recessed from the projection of the outer shell of the housing toward the proximal side (i.e., in the axial direction away from the combustion chamber), forming a step between the combustion chamber window and the projection.

Consequently, when the flow of air-fuel mixture or fuel spray in the combustion chamber passes through the outer surface of the combustion chamber window, a vortex flow may be generated in the vicinity of the step formed between the combustion chamber window and the projection of the housing, causing unburned fuel or soot included in the flow to deposit on the inside of the step. Further, the deposit of the unburned fuel or soot may gradually expand from the outer periphery to the center of the outer surface of the combustion chamber window, causing the optical axis of the pulsed laser light to be distorted and thereby making it impossible to perform normal ignition of the air-fuel mixture.

In addition, an ignition failure due to the deposit of unburned fuel or soot on the outer surface of an optical window member may be caused not only in the laser ignition apparatus disclosed in Patent Document 3, but also in other existing laser ignition apparatuses.

SUMMARY

According to an exemplary embodiment, a laser ignition apparatus is provided which includes an excitation light source, an introducing optical element, a laser resonator, an enlarging optical element, a focusing optical element, an optical window member, and a substantially cylindrical housing. The excitation light source is configured to output an excitation light. The introducing optical element is configured to regulate the beam diameter of the excitation light outputted from the excitation light source to a predetermined value and introduce the beam diameter-regulated excitation light to the laser resonator. The laser resonator is configured to generate, upon introduction of the beam diameter-regulated excitation light thereto by the introducing optical element, a pulsed laser light and output the generated pulsed laser light. The enlarging optical element is configured to enlarge the beam diameter of the pulsed laser light outputted from the laser resonator and output the beam diameter-enlarged pulsed laser light. The focusing optical element is configured to focus the beam diameter-enlarged pulsed laser light outputted from the enlarging optical element to a predetermined focal point in a combustion chamber of an engine, thereby igniting an air-fuel mixture in the combustion chamber. The optical window member is provided on a combustion chamber side of the focusing optical element to protect the focusing optical element. The housing receives therein the introducing optical element, the laser resonator, the enlarging optical element, the focusing optical element and the optical window member. The housing has a male-threaded portion for fixing the housing and a hexagonal portion for tightening the male-threaded portion. Between a combustion chamber-side end of the male-threaded portion and an anti-combustion chamber-side end of the hexagonal portion, there is defined a non-optical element arrangement region in which none of the introducing optical element, the enlarging optical element and the focusing optical element is arranged. At one of a combustion chamber-side end and an anti-combustion chamber-side end of the non-optical element arrangement region, there is formed a reference surface that extends perpendicular to an axial direction of the housing. One of the introducing optical element, the enlarging optical element and the focusing optical element is received in the housing in such a manner as to be elastically pressed against the reference surface from outside of the non-optical element arrangement region.

With the above configuration, when the hexagonal portion of the housing is turned for tightening the male-threaded portion, both the tightening axial load imposed on the male-threaded portion and the tightening torque imposed on the hexagonal portion will not be transmitted to the introducing optical element, the enlarging optical element and the focusing optical element. Consequently, both distortion of the optical axes of the optical elements and misalignment between the optical axes of the optical elements can be prevented from occurring during the fixing of the housing. In addition, since the one of the introducing optical element, the enlarging optical element and the focusing optical element is elastically pressed against the reference surface, the distance between a focal point of that optical element and the reference surface can be constant.

In a further implementation, the male-threaded portion is a first male-threaded portion, the hexagonal portion is a first hexagonal portion, and the non-optical element arrangement region is a first non-optical element arrangement region, and the reference surface is a first reference surface. The housing has a double structure consisting of an outer housing and an inner housing that is partially received in the outer housing. Both the outer and inner housings are substantially cylindrical in shape. The first male-threaded portion is formed on an outer periphery of the outer housing for fixing the outer housing to a cylinder head of the engine. The first hexagonal portion is also formed on the outer periphery of the outer housing for tightening the first male-threaded portion into a female-threaded hole formed in the cylinder head. The first hexagonal portion is positioned on the anti-combustion chamber side of the first male-threaded portion. The first non-optical element arrangement region is defined between the combustion chamber-side end of the first male-threaded portion and the anti-combustion chamber-side end of the first hexagonal portion. A second male-threaded portion is formed on an outer periphery of the inner housing for fixing the inner housing to the outer housing. The second male-threaded portion is positioned on the anti-combustion chamber side of the first hexagonal portion. A second hexagonal portion is also formed on the outer periphery of the inner housing for tightening the second male-threaded portion into a female-threaded portion formed in the outer housing. The second hexagonal portion is positioned on the anti-combustion chamber side of the second male-threaded portion. Between a combustion chamber-side end of the second male-threaded portion and an anti-combustion chamber-side end of the second hexagonal portion, there is defined a second non-optical element arrangement region in which none of the introducing optical element, the enlarging optical element and the focusing optical element is arranged. At the combustion chamber-side end of the first non-optical element arrangement region, there is provided the first reference surface. On the combustion chamber side of the first reference surface, there is formed in the outer housing a first optical element-receiving space, in which the focusing optical element is received so as to be elastically pressed against the first reference surface. At the anti-combustion chamber-side end of the first non-optical element arrangement region, there is provided a second reference surface that extends perpendicular to the axial direction of the housing. On the anti-combustion chamber side of the second reference surface, there is formed in the outer housing a second optical element-receiving space, in which the enlarging optical element is received so as to be elastically pressed against the second reference surface. At the anti-combustion chamber-side end of the second non-optical element arrangement region, there is provided a third reference surface that extends perpendicular to the axial direction of the housing. On the anti-combustion chamber side of the third reference surface, there is formed in the inner housing a third optical element-receiving space, in which the introducing optical element is received so as to be elastically pressed against the third reference surface. Within the second non-optical element arrangement region, there is formed in the inner housing a resonator-receiving space, in which the laser resonator is axially slidably received. An elastic member is interposed between the laser resonator and the enlarging optical element so as to elastically press an anti-combustion chamber-side end face of the laser resonator against a combustion chamber-side end face of the introducing optical element and elastically press a combustion chamber-side end face of the enlarging optical element against the second reference surface.

With the above configuration, during the fixing of the outer housing to the cylinder head as well as during the fixing of the inner housing to the outer housing, it is possible to prevent all the optical axes of the introducing optical element, the enlarging optical element and the focusing optical element from being distorted and prevent misalignment between the optical axes of the optical elements from occurring. In addition, since the introducing optical element, the enlarging optical element and the focusing optical element are respectively elastically pressed against the first, second and third reference surfaces, it is possible keep the optical distances between the optical elements constant.

It is preferable that the optical window member is received in the housing so that a combustion chamber-side end face of the optical window member is flush with a combustion chamber-side end face of the housing. Alternatively, it is also preferable that the optical window member is received in the housing so that the combustion chamber-side end face of the optical window member protrudes from the combustion chamber-side end face of the housing toward the combustion chamber.

In the above cases, when the flow of air/fuel mixture in the combustion chamber passes through the combustion chamber-side end face of the optical window member, it is possible for the flow to blow off unwanted matter (e.g., unburned fuel or soot) having adhered to the combustion chamber-side end face of the optical window member, thereby cleaning the combustion chamber-side end face. As a result, it is possible to prevent the optical axis of the pulsed laser light from being distorted by deposit of the unwanted matter on the combustion chamber-side end face of the optical window member, thereby ensuring stable ignition of the air-fuel mixture by the pulsed laser light.

In the laser ignition apparatus, the reference surface may be formed at the combustion chamber-side end of the non-optical element arrangement region. The focusing optical element may be received in the housing so as to be positioned on the combustion chamber side of the reference surface. In this case, it is preferable that the laser ignition apparatus further includes means for elastically pressing the focusing optical element against the reference surface. The elastically pressing means may wrap and press a side surface of the optical window member, with the focusing optical element axially interposed between the optical window member and the reference surface, so that a component of the pressing force of the means acts on the side surface of the optical window member in the axial direction away from the combustion chamber.

Further, the elastically pressing means may be made up of a crimped portion formed in the housing at the combustion chamber-side end of the housing.

Alternatively, between the optical window member and the focusing optical element, there may be interposed a substantially cylindrical elastic member that has a higher coefficient of thermal expansion than the housing. The elastically pressing means may be made up of a crimped portion formed in the elastic member at the combustion chamber-side end of the elastic member.

The side surface of the optical window member may have a frustoconical shape tapering toward the combustion chamber.

Alternatively, the side surface of the optical window member may be stepped to include a small-diameter portion on the combustion chamber side and a large-diameter portion on the anti-combustion chamber side; the large-diameter portion has a larger diameter than the small-diameter portion.

It is further preferable that the housing has a heat-deformed portion axially positioned between the reference surface and the elastically pressing means. The heat-deformed portion may be formed by axially pressing a thin-wall portion of the housing while heating the thin-wall portion to permanently deform it; the thin-wall portion is provided between the reference surface and the elastically pressing means and has a smaller wall thickness than other portions of the housing.

With the heat-deformed portion, an axial compression stress will be generated in the housing. Consequently, when the housing is expanded by the heat generated by combustion of the air-fuel mixture in the combustion chamber, it is possible to compensate the decrease in the pressing force (or wrapping force) of the elastically pressing means due to the thermal expansion of the housing with the axial force of the heat-deformed portion, thereby keeping the optical window member and the focusing optical element together elastically pressed against the reference surface. As a result, it is possible to prevent the optical axis of the pulsed laser light from being distorted due to looseness of the focusing optical element, thereby more reliably ensuring stable ignition of the air-fuel mixture by the pulsed laser light.

It is also preferable that a substantially annular elastic member is axially interposed between the optical window member and the focusing optical element, so that an outer surface of the elastic member abuts an inner surface of the housing and an inner surface of the elastic member abuts a side surface of the optical window member. The elastic member is made of a material having a larger coefficient of thermal expansion than the housing. The abutting pair of the inner surface of the elastic member and the side surface of the optical window member both taper in the axial direction away from the combustion chamber.

With the elastic member interposed between the optical window member and the focusing optical element, when the housing is expanded by the heat generated by combustion of the air-fuel mixture in the combustion chamber, it is possible to compensate the decrease in the pressing force (or wrapping force) of the elastically pressing means due to the thermal expansion of the housing with the thermal expansion force of the elastic member, thereby keeping the focusing optical element elastically pressed against the reference surface. As a result, it is possible to prevent the optical axis of the pulsed laser light from being distorted due to looseness of the focusing optical element, thereby more reliably ensuring stable ignition of the air-fuel mixture by the pulsed laser light.

It is preferable that the laser ignition apparatus further includes a cooling device that is made of a material having a higher heat conductivity than the housing. In the cooling device, there is formed a cooling channel so as to surround an outer periphery of the housing at least on the anti-combustion chamber side of the laser resonator.

With the cooling device, it is possible to cool the laser resonator together with the housing when the beam diameter-regulated excitation light is introduced by the introducing optical element to the laser resonator and thereby generates heat in the laser resonator. As a result, it is possible to prevent the optical axis of the pulsed laser light from being distorted due to a thermal stress induced in the laser resonator by the differences in coefficient of thermal expansion between the laser resonator and the housing. It is also possible to suppress increase in the temperature of a laser medium included in the laser resonator, thereby suppressing variation in the cycle of the pulsed laser light to ensure more stable ignition of the air-fuel mixture by the pulsed laser light.

It is further preferable that the cooling device is detachably attached to the housing only by means of elastic forces of first and second O-rings that are both made of an elastic material and respectively interposed between an anti-combustion chamber-side inner surface of the cooling device and an outer surface of the housing and between a combustion chamber-side inner surface of the cooling device and the outer surface of the housing.

With the first and second O-rings, the fluid-tightness of the cooling channel formed in the cooling device is secured. Moreover, since the cooling device is detachably attached to the housing only by means of the elastic forces of the first and second O-rings, it is possible to facilitate maintenance of the cooling device.

It is preferable that the cooling device is configured so that a coolant cooled by an external heat exchanger flows into the cooling channel, is heated while passing through the cooling channel and flows out of the cooling channel to the external heat exchanger.

With the above configuration, since the coolant circulating through the coolant channel of the cooling device is cooled by the external heat exchanger, it is possible to simplify the structure of the cooling device and minimize the overall size of the laser ignition apparatus, thereby facilitating the mounting of the laser ignition apparatus in the limited space inside a plug hole formed in the cylinder head.

In the laser ignition apparatus, the excitation source may be located outside of the housing, and the excitation light outputted from the excitation light source may be transmitted to the introducing optical element via an optical fiber.

In the laser ignition apparatus, each of the introducing optical element, the enlarging optical element and the focusing optical element may be configured with an optical lens and a substantially cylindrical enclosure that retains the optical lens therein. The optical lens is configured to receive a light that has a given angle of incidence and output a light that has a given angle of emergence. The enclosure has both end faces thereof perpendicular to its longitudinal axis, so as to position a focal point of the optical lens with respect to the reference surface.

BRIEF DESCRIPTION OF THE DRAWINGS

The present invention will be understood more fully from the detailed description given hereinafter and from the accompanying drawings of exemplary embodiments, which, however, should not be taken to limit the invention to the specific embodiments but are for the purpose of explanation and understanding only.

In the accompanying drawings.

DESCRIPTION OF EMBODIMENTS

Figure 1:
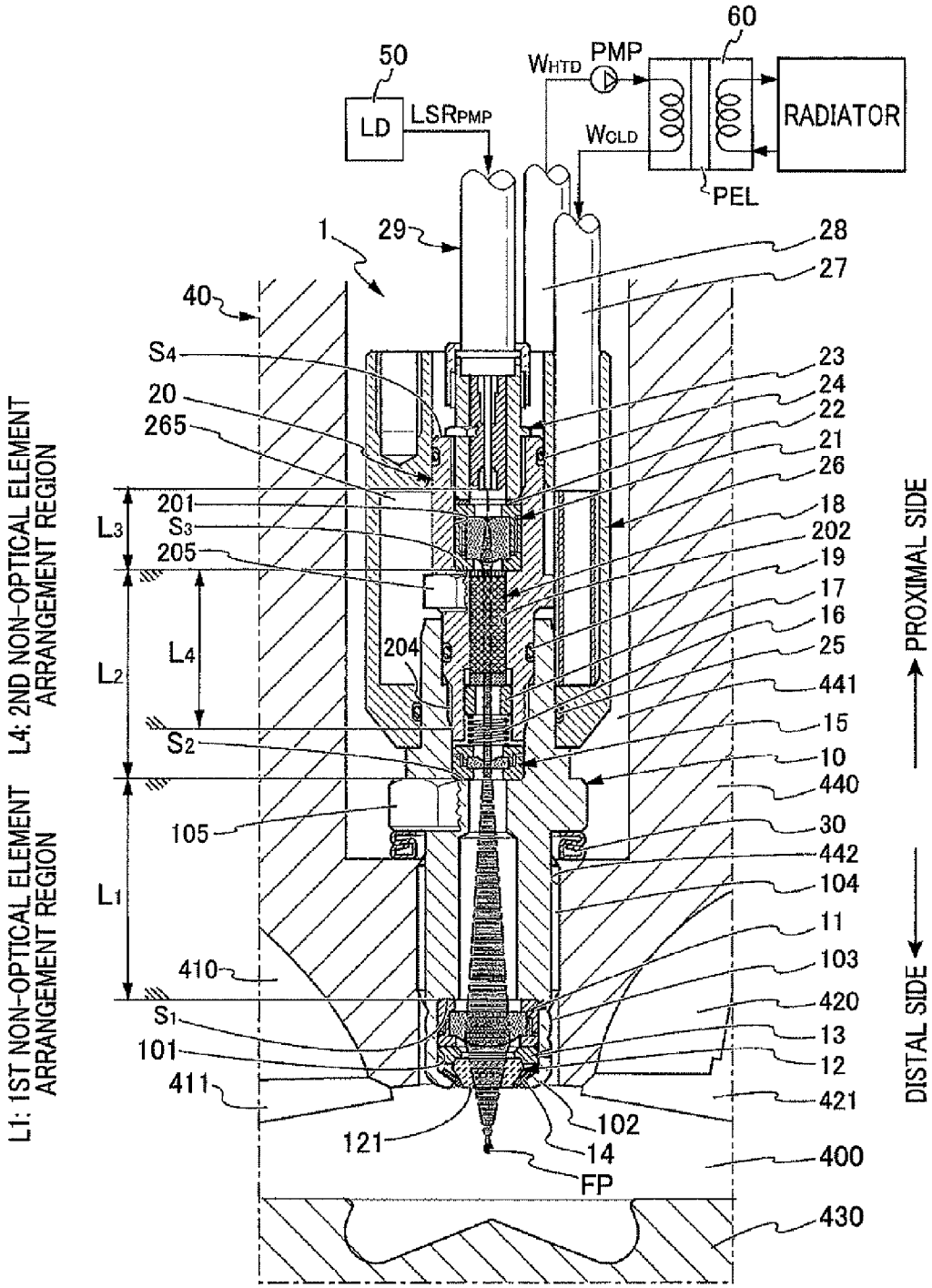
FIG. 1 is a schematic cross-sectional view illustrating the overall configuration of a laser ignition apparatus according to a first embodiment.

Exemplary embodiments and their modifications will be described hereinafter with reference to FIGS. 1-11. It should be noted that for the sake of clarity and understanding, identical components having identical functions throughout the whole description have been marked, where possible, with the same reference numerals in each of the figures and that for the sake of avoiding redundancy, descriptions of the identical components will not be repeated.

First Embodiment

FIG. 1 shows the overall configuration of a laser ignition apparatus 1 according to a first embodiment. The laser ignition apparatus 1 is configured to ignite the air-fuel mixture in a combustion chamber 400 of an internal combustion engine 40.

As shown in FIG. 1, the laser ignition apparatus 1 includes an excitation light source 50, an introducing optical element 21, a laser resonator (or optical resonator) 18, an enlarging optical element 15, a focusing optical element 11, an optical window member 12, and a housing which has a double structure consisting of an outer housing 10 and an inner housing 20 that is partially received in the outer housing 10. Both the outer and inner housings 10 and 20 are substantially cylindrical in shape.

The excitation light source 50 is provided outside of both the outer and inner housings 10 and 20 and configured to output an excitation light $LSR_{PMP}$. The outputted excitation light $LSR_{PMP}$ is then transmitted to the introducing optical element 21 via an optical fiber 29. The introducing optical element 21 regulates the beam diameter of the excitation light $LSR_{PMP}$ to a predetermined value and introduces the beam diameter-regulated excitation light $LSR_{PMP}$ to the laser resonator 18. Upon introduction of the beam diameter-regulated excitation light $LSR_{PMP}$, the laser resonator 18 generates a pulsed laser light $LSR_{PLS}$ that has a high energy density. The enlarging optical element 15 enlarges the beam diameter of the pulsed laser light $LSR_{PLS}$ generated by the laser resonator 18 and outputs the beam diameter-enlarged pulsed laser light $LSR_{PLS}$ to the focusing optical element 11. Then, the focusing optical element 11 focuses the beam diameter-enlarged pulsed laser light $LSR_{PLS}$ to a predetermined focal point FP in the combustion chamber 400, thereby forming a flame kernel of a high energy density to ignite the air-fuel mixture in the combustion chamber 400. The optical window member 12 is provided to protect the focusing optical element 11. The outer and inner housings 10 and 20 together receive the above-described components 11, 12, 15, 18 and 21 of the laser ignition apparatus 1 therein, and are fixed to a cylinder head 440 of the engine 40 so as to hold those components 11, 12, 15, 18 and 21 within a plug hole 441 formed in the cylinder head 440.

In the present embodiment, each of the optical elements 11, 15 and 21 is configured to include an optical lens 110, 150 or 210 and a substantially cylindrical enclosure (or case) 111, 151 or 213. The optical lens is configured to receive a light that has a given angle of incidence and output a light that has a given angle of emergence. The enclosure is provided to retain the optical lens therein. The enclosure has both end faces thereof perpendicular to its longitudinal axis, so as to position the focal point of the optical lens with respect to a corresponding one of first to third reference surfaces S1, S2 and S3.

The outer housing 10 has a male-threaded portion 104 for fixing the outer housing 10 to the cylinder head 440 and a hexagonal portion 105 for tightening the male-threaded portion 104. Between a distal-side end of the male-threaded portion 104 and a proximal-side end of the hexagonal portion 105, there is defined a first non-optical element arrangement region L1 in which none of the optical elements 11, 15 and 21 is arranged. Hereinafter, the distal side denotes the combustion chamber 400 side while the proximal side denotes the anti-combustion chamber side (or the opposite side to the combustion chamber 400).

The inner housing 20 has a male-threaded portion 204 for fixing the inner housing 20 to the outer housing 10 and a hexagonal portion 205 for tightening the male-threaded portion 204. Between a distal-side end of the male-threaded portion 204 and a proximal-side end of the hexagonal portion 205, there is defined a second non-optical element arrangement region L4 in which none of the optical elements 11, 15 and 21 is arranged.

The first reference surface S1 is provided to extend, at the distal-side end of the first non-optical element arrangement region L1, perpendicular to an axial direction of the housing (i.e., the axial direction of the outer and inner housings 10 and 20). More specifically, in the present embodiment, the first reference surface S1 is formed in the outer housing 10 as an annular seat surface facing toward the distal side.

The second reference surface S2 is provided to extend, at the proximal-side end of the first non-optical element arrangement region L1, perpendicular to the axial direction of the housing. More specifically, in the present embodiment, the second reference surface S2 is formed in the outer housing 10 as an annular seat surface facing toward the proximal side.

The third reference surface S3 is provided, at the proximal-side end of the second non-optical element arrangement region L4, perpendicular to the axial direction of the housing.

More specifically, in the present embodiment, the third reference surface S3 is formed in the inner housing 20 as an annular seat surface facing toward the proximal side.

Further, on the distal side of the first reference surface S1, there is formed in the outer housing 10 a first optical element-receiving space 101 for receiving the focusing optical element 11. On the proximal side of the second reference surface S2, there is formed in the outer housing 10 a second optimal element-receiving space 106 (see FIG. 2) for receiving the enlarging optical element 15. On the proximal side of the third reference surface S3, there is formed in the inner housing 20 a third optical element-receiving space 201 for receiving the introducing optical element 21.

Furthermore, within the second non-optical element arrangement region L4, there is formed in the inner housing 20 a resonator-receiving space 202 for slidably receiving the laser resonator 18. Between the laser resonator 18 and the enlarging optical element 15, there is interposed a spring member (or an elastic member) 16. By the elastic force of the spring member 16, a proximal-side end face of the laser resonator 18 is elastically pressed against a distal-side end face 214 of the introducing optical element 21 that abuts the third reference surface S3 (see FIGS. 1 and 4). Also by the elastic force of the spring member 16, a distal-side end face 151 of the enlarging optical element 15 is elastically pressed against the second reference surface S2.

Figure 2:
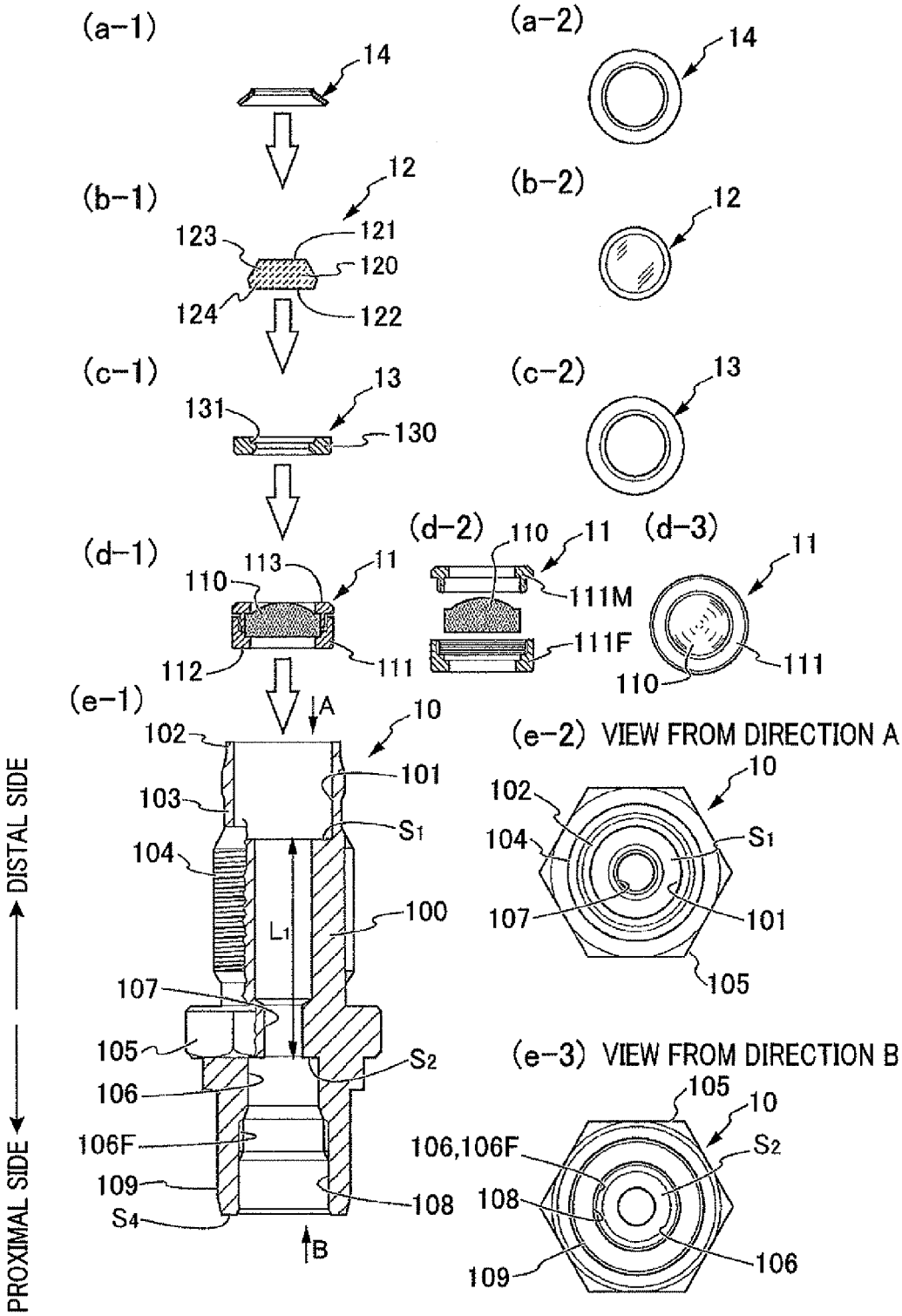
FIG. 2 is a schematic diagram illustrating the detailed configurations of an outer housing, a focusing optical element and an optical window member of the laser ignition apparatus as well as an assembly process of those components of the apparatus, wherein sub-diagrams on the left side are cross-sectional views and sub-diagrams on the right side are plan views.

Moreover, in the present embodiment, as shown in FIGS. 1 and 2, the optical window member 12 has such a substantially frustoconical shape that a distal-side end face 121 of the optical window member 12 is flush with a distal-side end face of the outer housing 10 and the diameter of a distal-side side surface 123 of the optical window member 12 continuously decreases in the axial direction toward the distal side.

Further, as means for elastically pressing the focusing optical element 11 received in the first optical element-receiving space 101 against the first reference surface S1, there is formed a crimped portion 102 in the outer housing 10. The crimped portion 102 wraps and presses the distal-side side surface 123 of the optical window member 12 via a substantially annular plate (or elastic member) 14 so that a component of the pressing force of the crimped portion 102 acts on the distal-side side surface 123 in the axial direction toward the proximal side. The plate 14 has a larger coefficient of thermal expansion than the outer housing 10.

With the distal-side end face 121 of the optical window member 12 flush with the distal-side end face of the outer housing 10, when the flow TMB of air/fuel mixture in the combustion chamber 400 passes through the distal-side end face 121 of the optical window member 12, it is possible for the flow TMB to blow off unwanted matter (e.g., unburned fuel or soot) having adhered to the distal-side end face 121, thereby cleaning the distal-side end face 121. As a result, it is possible to prevent the optical axis of the pulsed laser light $LSR_{PLS}$ from being distorted by deposit of the unwanted matter on the distal-side end face 121, thereby ensuring stable ignition of the air-fuel mixture by the pulsed laser light $LSR_{PLS}$.

Further, in the outer housing 10, there is formed a heat-deformed portion 103. The heat-deformed portion 103 is obtained by axially pressing a thin-wall portion of the outer housing 10 provided between the first reference surface S1 and the crimped portion 102 while heating the thin-wall portion to permanently deform it. In addition, the thin-wall portion has a smaller wall thickness than other portions of the outer housing 10.

With the heat-deformed portion 103, an axial compression stress is generated in the outer housing 10. Consequently, when the outer housing 10 is expanded by the heat generated by combustion of the air-fuel mixture in the combustion chamber 400, it is possible to compensate the decrease in the pressing force (or wrapping force) of the crimped portion 102 due to the thermal expansion of the outer housing 10 with the axial force of the heat-deformed portion 103, thereby keeping the optical window member 12 and the focusing optical element 11 together elastically pressed against the first reference surface S1. As a result, it is possible to prevent the optical axis of the pulsed laser light $LSR_{PLS}$ from being distorted due to looseness of the focusing optical element 11, thereby more reliably ensuring stable ignition of the air-fuel mixture by the pulsed laser light $LSR_{PLS}$.

Figure 5:
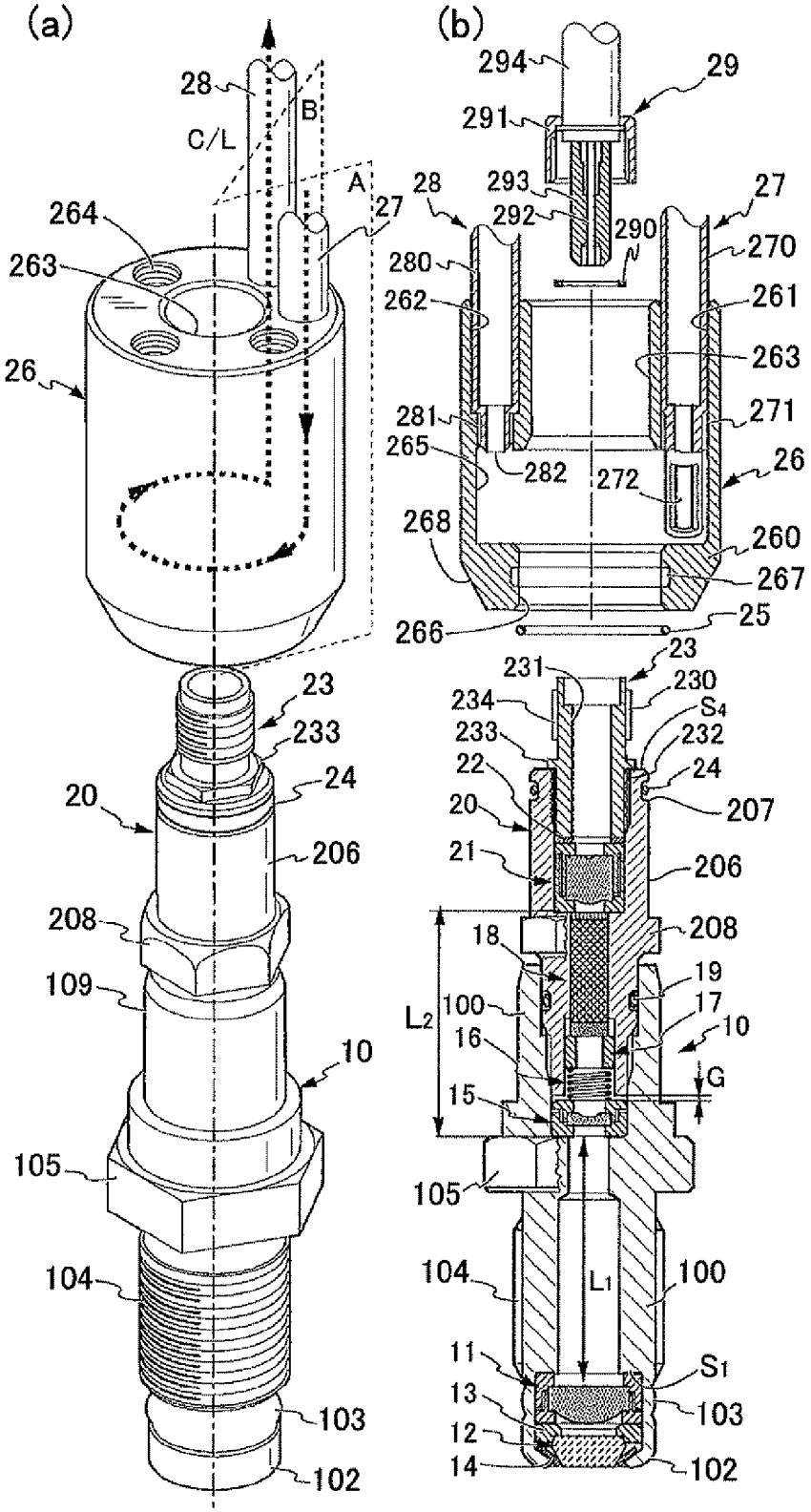
FIG. 5 is a schematic diagram illustrating the detailed configuration as well as an assembly process of a cooling device of the laser ignition apparatus, wherein the sub-diagram (a) is a perspective view and the sub-diagram (b) is a cross-sectional view taken along the half-planes A and B in the sub-diagram (a)

As shown in FIGS. 1 and 5, the laser ignition apparatus 1 further includes a cooling device 26 that is made of a material having a higher heat conductivity than the material of which the inner housing 20 is made. The cooling device 26 has a cooling channel 265 formed therein. The cooling channel 265 has the shape of an annular groove and surrounds both the outer periphery of the third optical element-receiving space 201 formed in the inner housing 20 for receiving the introducing optical element 21 and the outer periphery of the resonator-receiving space 202 formed in the inner housing 20 for receiving the laser resonator 18. The cooling device 26 also has a proximal-side inner surface 263 facing a proximal-side outer surface 206 of the inner housing 20 and a distal-side inner surface 266 facing a proximal-side outer surface 109 of the outer housing 10. O-rings 24 and 25, which are made of an elastic material, are respectively interposed between the proximal-side inner surface 263 of the cooling device 26 and the proximal-side outer surface 206 of the inner housing 20 and between the distal-side inner surface 266 and the proximal-side outer surface 109 of the outer housing 10, thereby securing fluid-tightness of the cooling channel 265. Further, with the elastic O-rings 24 and 25, the cooling device 26 is detachably attached to the outer and inner housings 10 and 20. In addition, a coolant cooled by an external heat exchanger 60 is made to circulate through the cooling channel 265.

Consequently, with fluid-tightness of the cooling channel 265 secured by the O-rings 24 and 25 and with the coolant circulating around both the outer peripheries of the third optical element-receiving space 201 and resonator-receiving space 202 formed in the inner housing 20, it is possible to cool the laser resonator 18 together with the outer and inner housings 10 and 20 when the beam diameter-regulated excitation light $LSR_{PMP}$ is introduced by the introducing optical element 21 to the laser resonator 18 and thereby generates heat in the laser resonator 18.

As a result, it is possible to prevent the optical axis of the pulsed laser light $LSR_{PLS}$ from being distorted due to a thermal stress induced in the laser resonator 18 by the differences in coefficient of thermal expansion between the laser resonator 18 and the outer and inner housings 10 and 20.

It is also possible to suppress increase in the temperature of a laser medium included in the laser resonator 18, thereby suppressing variation in the cycle of the pulsed laser light $LSR_{PLS}$ to ensure more stable ignition of the air-fuel mixture by the pulsed laser light $LSR_{PLS}$.

Moreover, since the cooling device 26 is detachably attached to the outer and inner housings 10 and 20, it is possible to facilitate maintenance of the cooling device 26.

Furthermore, since the coolant circulating through the coolant channel 265 of the cooling device 26 is cooled by the external heat exchanger 60, it is possible to simplify the structure of the cooling device 26 and minimize the overall size of the laser ignition apparatus 1, thereby facilitating the mounting of the laser ignition apparatus 1 in the limited space inside the plug hole 441.

In addition, it should be noted that in FIG. 1, "$W_{CLD}$" denotes the coolant which is flowing into the cooling device 26 after being cooled by the external heat exchanger 60, while "$W_{HTD}$" denotes the coolant which is flowing out of the cooling device 26 to the external heat exchanger 60 after absorbing heat generated in the laser resonator 18 when passing through the coolant channel 265.

Moreover, in the present embodiment, as shown in FIGS. 1 and 2, an annular seat ring (or elastic member) 13 is interposed between the optical window member 12 and the focusing optical element 11, so that an outer surface 130 of the seat ring 13 abuts the inner surface of the outer housing 10 and a distal-side inner surface 131 of the seat ring 13 abuts a proximal-side side surface 124 of the optical window member 12. The seat ring 13 is made of a metal material having a larger coefficient of thermal expansion than the outer housing 10. In addition, the abutting pair of the distal-side inner surface 131 of the seat ring 13 and the proximal-side side surface 124 of the optical window member 12 both taper toward the proximal side.

With the seat ring 13 interposed between the optical window member 12 and the focusing optical element 11, when the outer housing 10 is expanded by the heat generated by combustion of the air-fuel mixture in the combustion chamber 400, it is possible to compensate the decrease in the pressing force of the crimped portion 102 due to the thermal expansion of the outer housing 10 with the thermal expansion force of the seat ring 13, thereby keeping the focusing optical element 11 elastically pressed against the first reference surface S1. As a result, it is possible to prevent the optical axis of the pulsed laser light $LSR_{PLS}$ from being distorted due to looseness of the focusing optical element 11, thereby more reliably ensuring stable ignition of the air-fuel mixture by the pulsed laser light $LSR_{PLS}$.

In the present embodiment, the excitation light source 50 is comprised of at least one laser diode that is made of a well-known crystalline material such as GaAlAs or InGaAs. The excitation light source 50 emits the excitation light $LSR_{PMP}$ upon being supplied with a drive current at a given ignition timing according to the operating condition of the engine.

In addition, it should be noted that the excitation light source 50 may also be implemented by other types of light sources, such as a flash lamp.

The external heat exchanger 60 may be of any configuration provided that it can cool the coolant so as to keep the temperature of the laser resonator 18 not higher than a predetermined value (e.g., 40° C.).

In the present embodiment, as shown in FIG. 1, the external heat exchanger 60 is configured by combining a circulating pump PMP, at least one Peltier element PEL, a radiator for cooling the engine and a cooling fan (not shown).

The Peltier element is a substantially plate-shaped semiconductor optical element that utilizes the Peltier effect to create a heat flux between two different types of materials with electric current supplied to the junction of the two materials. In the external heat exchanger 60, the coolant $W_{HTD}$ flowing out of the cooling device 26 via an outlet pipe 28 is recirculated by the circulating pump PMP to pass through a cooling surface of the Peltier element PEL, thereby being cooled by the Peltier element PEL to become the coolant $W_{CLD}$ whose temperature is not higher than 30° C. The coolant $W_{CLD}$ flows into the cooling device 26 via an inlet pipe 27. The heat transferred from the coolant $W_{HTD}$ to the Peltier element PEL is further removed from the Peltier element PEL via heat exchange between the Peltier element PEL and the cooling water for the engine as well as via heat dissipation by the cooling fan.

In addition, when the cooling water for the engine has such a sufficient cooling effect as to keep the temperature of the laser resonator 18 not higher than 40° C. or the amount of heat generated in the laser resonator 18 is sufficiently suppressed by an improvement in the light transformation efficiency of the laser resonator 18, it is possible to omit the at least one Peltier element PEL from the external heat exchanger 60, thereby simplifying the structure of the external heat exchanger 60.

Next, the detailed configurations of the outer housing 10, the focusing optical element 11, the optical window member 12, the seat ring 13 and the plate 14 of the laser ignition apparatus 1 according to the present embodiment and an assembly process of those components will be described with reference to FIGS. 1-3.

It should be noted that in FIG. 2, the upper and lower sides respectively correspond to the distal and proximal sides and the focusing optical element 11, the seat ring 13, the optical window member 12 and the plate 14 are shown from the lower side in the order of being received in the first optical element-receiving space 101 formed in the outer housing 10.

The plate 14 is made of a metal material (e.g., an austenitic stainless steel SUS304 or SUS316) that has a higher coefficient of thermal expansion than the metal material (e.g., a carbon steel S10C or S20C) of which the outer housing 10 is made. Moreover, as shown in the sub-diagrams (a-1) and (a-2) of FIG. 2, the plate 14 has a substantially annular shape.

The optical window member 12 is made of a transparent heat-resistant glass such as sapphire or quartz glass. Moreover, as shown in the sub-diagrams (b-1) and (b-2) of FIG. 2, the optical window member 12 has the distal-side end face 121 facing the combustion chamber 400, a proximal-side end face 122 facing the focusing optical element 11, the distal-side side surface 123 tapering toward the distal side, and the proximal-side side surface 124 tapering toward the proximal side.

The seat ring 13 is made of a metal material (e.g., an austenitic stainless steel SUS304 or SUS316) that has a higher coefficient of thermal expansion than the metal material (e.g., a carbon steel S10C or S20C) of which the outer housing 10 is made. Moreover, as shown in the sub-diagrams (c-1) and (c-2) of FIG. 2, the seat ring 13 has an annular shape. In the distal-side inner periphery of the seat ring 13, there is formed a substantially trapezoidal groove into which a proximal-side end portion of the optical window member 12 is to be fitted. The diameter of the distal-side inner surface 131 of the seat ring 13 (i.e., the diameter of the groove of the seat ring 13) is gradually increased in the direction toward the distal side so as to allow the proximal-side side surface 124 of the optical window member 12 to be brought into contact with the distal-side inner surface 131 of the seat ring 13. In addition, the diameter of the outer surface 130 of the seat ring 13 is set so as to allow the outer surface 130 to be brought into contact with the inner surface of the outer housing 10 which defines the first optical element-receiving space 101.

The focusing optical element 11 includes the focusing lens 110 and the substantially cylindrical enclosure 111, as shown in the sub-diagrams (d-1), (d-2) and (d-3) of FIG. 2. The focusing lens 110 has a predetermined focal length so as to focus the beam diameter-enlarged pulsed laser light $LSR_{PLS}$ incident from the proximal side to the predetermined focal point FP in the combustion chamber 400. The enclosure 111 receives the focusing lens 110 therein and is accurately machined so that both the proximal-side end face 112 and the distal-side end face 113 of the enclosure 111 is perpendicular to the optical axis of the focusing lens 110. The enclosure 111 also has such a positioning function that when the proximal-side end face 112 of the enclosure 111 abuts the first reference surface S1, the focusing lens 110 can focus the beam diameter-enlarged pulsed laser light $LSR_{PLS}$ to the predetermined focal point FP.

Moreover, between the outer side surface of the enclosure 111 of the focusing optical element 11 and the inner surface of the outer housing 10 which defines the first optical element-receiving space 101, there is provided such a small clearance as to allow the outer side surface of the enclosure 111 to be slidable against the inner surface of the outer housing 10. The focusing optical element 11 is received in the outer housing 10 such that the optical axis of the focusing lens 110 of the focusing optical element 11 coincides with the longitudinal axis of the outer housing 10.

The focusing lens 110 is made of a well-known optical material such as quartz glass. On both the light entrance surface and light exit surface of the focusing lens 110, there is formed a coat for suppressing reflection of the pulsed laser light $LSR_{PLS}$.

It should be noted that the enclosure 111 of the focusing optical element 11 may have a double structure consisting of a male enclosure 111M and a female enclosure 111F, as shown in the sub-diagram (d-2) of FIG. 2. With the double structure, it is possible to perform a fine adjustment of the focal point position of the focusing lens 110 by adjusting the end faces 112 and 113 of the enclosure 111. Moreover, during the formation of the crimped portion 102 of the outer housing 10, the crimping force is not directly applied to the focusing lens 110. Therefore, it is possible to prevent the focusing lens 110 from being damaged during the formation of the crimped portion 102.

It also should be noted that the enclosure 151 of the enlarging optical element 15 and the enclosure 213 of the introducing optical element 21, both of which will be described in detail later, may also have a similar double structure to the enclosure 111 of the focusing optical element 11.

In addition, an annular seat ring may be interposed between the focusing lens 110 and the enclosure 111 so as to improve the fluid-tightness therebetween. The seat ring may be made of a heat-resistant elastic material such as a fluororubber or a silicone rubber.

The outer housing 10 is made of a highly heat-resistant metal material such as carbon steel. Moreover, as shown in the sub-diagrams (e-1), (e-2) and (e-3) of FIG. 2, the outer housing 10 has a substantially cylindrical base body 100. In the distal-side inner periphery of the base body 100, there is formed the first optical element-receiving space 101. In the intermediate inner periphery of the base body 100, there is formed the second optimal element-receiving space 106. In the proximal-side inner periphery of the base body 100, there is formed a female-threaded portion 106F and an inner housing-receiving space 108.

The base body 100 has a thin-wall portion provided in the vicinity of the distal-side open end of the base body 100. When the base body 100 is crimped on the distal side in a manner to be described later, the thin-wall portion will be buckled radially inward by the crimping force, thereby forming the crimped portion 102 of the outer housing 10.

The first non-optical element arrangement region L1 is provided between the first reference surface S1 and the second reference surface S2. With the first non-optical element arrangement region L1, it is possible to keep the distance between the focusing optical element 11 and the enlarging optical element 15 constant.

On the distal-side outer periphery of the base body 100, there is formed the male-threaded portion 104 for fixing the outer housing 10 to the cylinder head 440. On the intermediate outer periphery of the base body 100, there is formed the hexagonal portion 105 for tightening the male-threaded portion 104 into a female-threaded hole 442 formed in the cylinder head 440. In addition, the tightening of the male-threaded portion 104 into the female-threaded hole 442 of the cylinder head 440 is performed with a gasket 30 interposed between the hexagonal portion 105 and the cylinder head 440 (see FIG. 1).

As shown in FIG. 2, the focusing optical element 11, the seat ring 13, the optical window member 12 and the plate 14 are sequentially placed in the first optical element-receiving space 101 of the outer housing 10. Then, those components 11, 13, 12 and 14 are fixed in the first optical element-receiving space 101 by a crimping process shown in FIG. 3.

Figure 3:
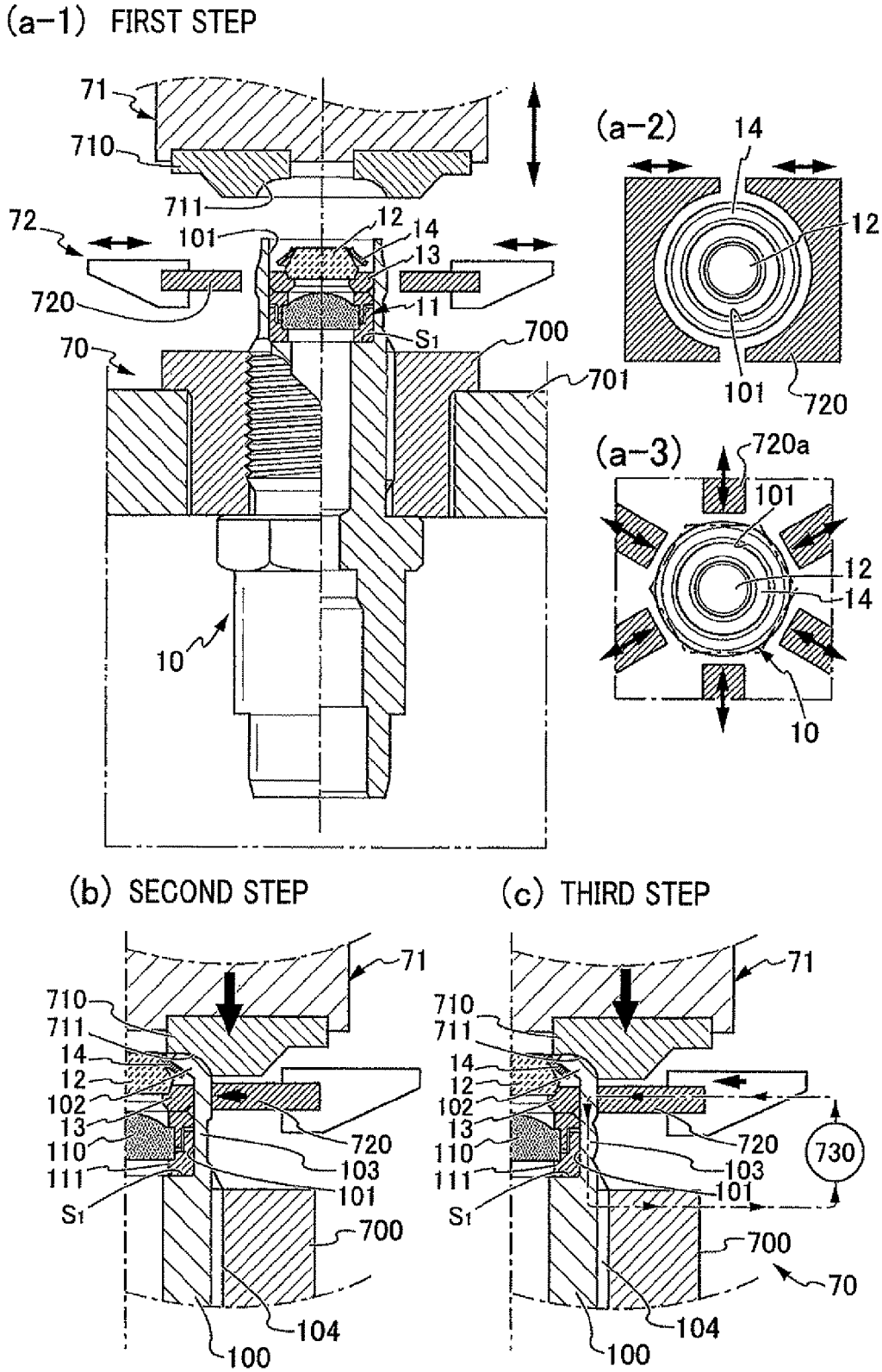
FIG. 3 is a schematic diagram illustrating processes of forming a crimped portion and a heat-deformed portion in the outer housing of the laser ignition apparatus.

In a first step of the crimping process, as shown in the sub-diagrams (a-1) and (a-2) of FIG. 3, the outer housing 10 is fixed to a fixing die 70 by utilizing the male-threaded portion 104. Then, a crimping die 710 is moved downward by a vertical moving device 71, while a pair of holding dies 720 is moved radially inward by a horizontal moving device 72 to make contact with the outer surface of the outer housing 10. The crimping die 710 has a substantially cup-shaped recess formed in the lower surface thereof. The holding dies 720 are used to hold the radially outer periphery of the outer housing 10 so as to allow only that part of the outer housing 10 which forms the crimped portion 102 to be buckled by the crimping force.

In addition, the fixing die 70 has a double structure consisting of an inner fixing die 700 and an outer fixing 701, so as to allow the outer housing 10 to be easily attached to and detached from the fixing die 70.

In a second step of the crimping process, as shown in the sub-diagram (b) of FIG. 3, the outer housing 10 is axially pressed by the crimping die 710 so that that part of the outer housing 10 which forms the crimped portion 102 is buckled radially inward and thereby brought into pressed contact with the plate 14. As a result, the crimped portion 102 of the outer housing 10 is obtained which wraps and presses the distal-side side surface 123 of the optical window member 12 via the plate 14.

In a third step of the crimping process, as shown in the sub-diagram (c) of FIG. 3, with the crimping die 710 continuously pressing the outer housing 10 and with the holding dies 720 and the inner fixing die 700 serving as electrodes, electric current is supplied between the crimped portion 102 and the male-threaded portion 104 of the outer housing 10, thereby heating the thin-wall portion of the outer housing 10 between the first reference surface S1 and the crimped portion 102. As a result, the thin-wall portion is permanently deformed to make up the heat-deformed portion 103 of the outer housing 10.

In addition, in the above crimping process, the pair of holding dies 720 as shown in the sub-diagram (a-2) of FIG. 2 is used to keep the circular shape of the thin-wall portion. However, instead of the holding dies 720, six holding dies 720*a* as shown in the sub-diagram (a-3) of FIG. 2 may be used to deform the thin-wall portion into a hexagonal shape.

Next, the detailed configurations of the inner housing 20, the enlarging optical element 15, the spring member 16, a collar (or elastic force transmitting member) 17, the laser resonator 18, the introducing optical element 21 and an optical fiber connecting member 23 of the laser ignition apparatus 1 according to the present embodiment and an assembly process of those components will be described with reference to FIGS. 1 and 4.

In addition, as will be described in detail later, the spring member 16, the collar 17, the laser resonator 18, the introducing optical element 21 and the optical fiber connecting member 23 are first received in the inner housing 20; then, the inner housing 20 is inserted in and connected to the outer housing 10 which has the focusing optical element 11, the optical window member 12 and the enlarging optical element 15 received therein.

The inner housing 20 is made of a meal material such as an aluminum alloy. Moreover, as shown in the sub-diagram (a-1) of FIG. 4, the inner housing 20 has a substantially cylindrical base body 200.

In the inner periphery of the base body 200, there are formed the third optical element-receiving space 201 for receiving the introducing optical element 21, a female-threaded portion 201M for fixing the optical fiber connecting member 23 to the inner housing 20, the resonator-receiving space 202 for receiving the laser resonator 18, and a receiving space 203 for receiving the collar 17 and the spring member 16.

On the outer periphery of the base body 200, there are formed the male-threaded portion 204 for fixing the inner housing 20 to the outer housing 10, the hexagonal portion 205 for tightening the male-threaded portion 204 into the female-threaded portion 106F of the outer housing 10, the proximal-side outer surface 206 for fitting with the cooling device 26, an annular groove 207 for receiving the O-ring 24 that is interposed between the inner housing 20 and the cooling device 26, a distal-side outer surface 208 for fitting with the outer housing 10, and an annular groove 209 for receiving an O-ring 19 that is interposed between the outer and inner housings 10 and 20.

The introducing optical element 21 is made of a well-known optical material such as quartz glass. The introducing optical element 21 includes the introducing lens 210 and the substantially cylindrical enclosure 213 for receiving the introducing lens 210.

The introducing lens 210 has a concave light entrance surface 211 and a convex light exit surface 212. The light entrance surface 211 and the light exit surface 212 have different radii of curvature so as to introduce the excitation light $LSR_{PMP}$ to the proximal-side end face of the laser resonator 18 at a predetermined focal length and a predetermined beam diameter. In addition, the excitation light $LSR_{PMP}$ is transmitted to the introducing optical element 21 from the excitation light source 50 via the optical fiber 29.

Figure 4:
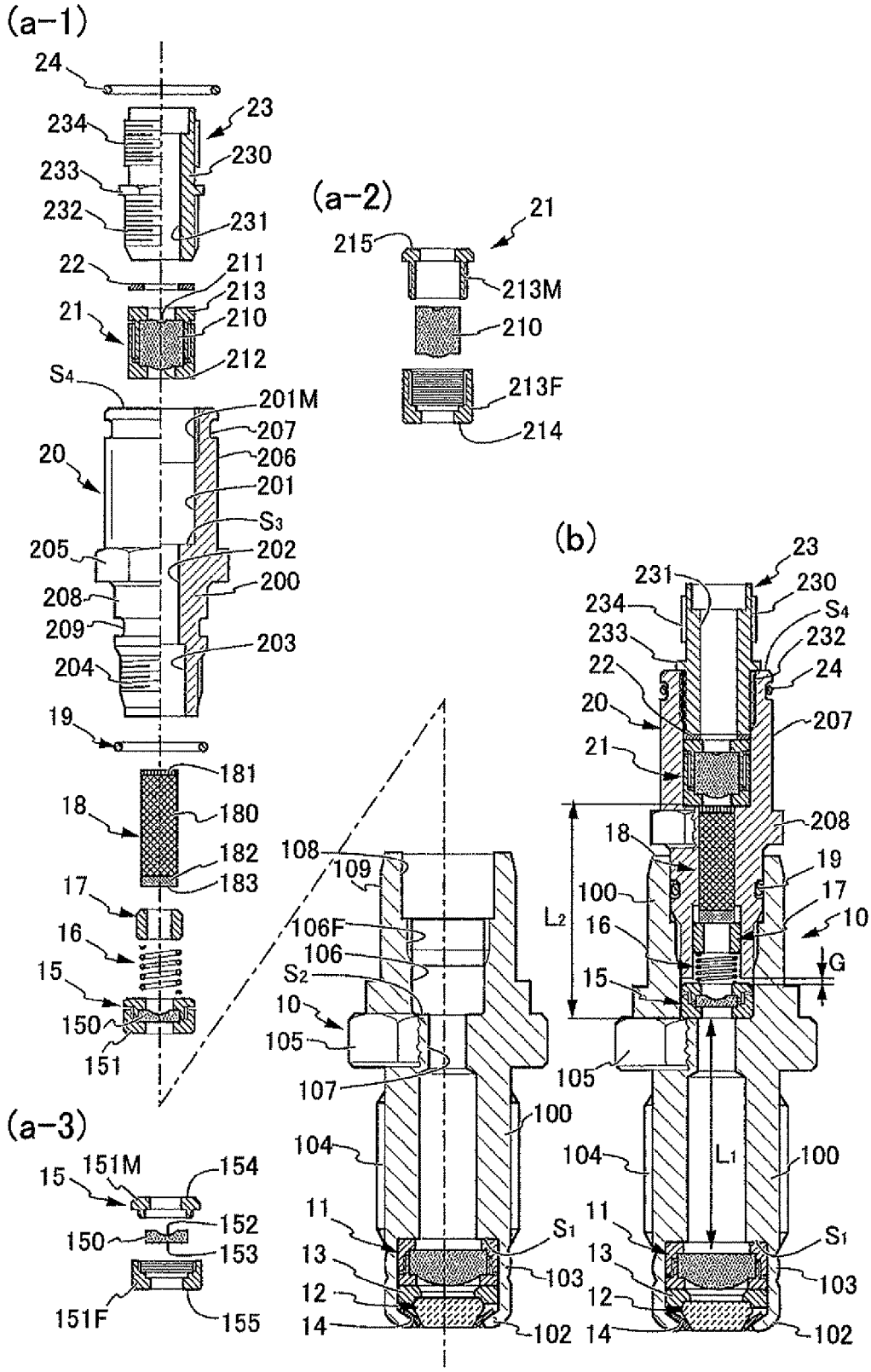
FIG. 4 is a schematic diagram illustrating the detailed configurations of an inner housing, an enlarging optical element, a laser resonator, an introducing optical element and an optical fiber-connecting member of the laser ignition apparatus as well as an assembly process of those components of the apparatus.

In the present embodiment, as shown in the sub-diagram (a-2) of FIG. 4, the enclosure 213 has a double structure consisting of a male enclosure 213M and a female enclosure 213F. The enclosure 213 receives the introducing lens 210 therein and is accurately machined so that both the distal-side end face 214 and the proximal-side end face 215 of the enclosure 213 is perpendicular to the optical axis of the introducing lens 210. The enclosure 213 also has such a positioning function that when the distal-side end face 214 of the enclosure 213 abuts the third reference surface S3, the introducing lens 210 can introduce the excitation light $LSR_{PMP}$ to the laser resonator 18 at the predetermined focal length and the predetermined beam diameter.

In the inner housing 20, there is formed the third optical element-receiving space 201 on the proximal side of the third reference surface S3. Further, in a proximal-side inner surface of the third optical element-receiving space 201, there is formed the female-threaded portion 201M for fixing the optical fiber connecting member 23 to the inner housing 20.

The optical fiber connecting member 23 is provided to connect the optical fiber 29 to the inner housing 20. The optical fiber connecting member 23 has a substantially cylindrical shape and is screwed into the inner housing 20 for a predetermined axial distance from a fourth reference surface S4. Here, the fourth reference surface S4 is represented by the proximal-side end face of the inner housing 20.

The laser resonator 18 is of a well-known type which includes a laser medium that is made of Nd:YAG (i.e., neodymium-doped yttrium aluminum garnet) and a passive Q switch that is made of Cr:YAG (i.e., $Cr^{+4}$-doped yttrium aluminum garnet). The laser resonator 18 is accurately machined to have a cylindrical shape.

More specifically, as shown in the sub-diagram (a-1) of FIG. 4, the laser resonator 18 includes a totally reflecting mirror 181, the laser medium 180, a saturable absorber 182 and a partially reflecting mirror 183, which are arranged in this order from the proximal side.

When the excitation light $LSR_{PMP}$, which has a wavelength $\lambda_{PMP}$ of, for example, 808.5 nm, is introduced into the laser resonator 18, the laser medium 180 is excited by the excitation light $LSR_{PMP}$ to produce the pulsed laser light $LSR_{PLS}$ that has a wavelength $\lambda_{PLS}$ of, for example, 1064 nm. That is, the wavelength $\lambda_{PLS}$ of the pulsed laser light $LSR_{PLS}$ is longer than the wavelength $\lambda_{PMP}$ of the excitation light $LSR_{PMP}$.

The totally reflecting mirror 181 is AR-coated so as to allow entrance of the excitation light $LSR_{PMP}$ from its light entrance surface (i.e., the proximal-side end face in FIG. 4) while totally reflecting the pulsed laser light $LSR_{PLS}$ produced by the laser medium 180.

The pulsed laser light $LSR_{PLS}$ produced by the laser medium 180 bounces back and forth between the totally reflecting mirror 181 and the partially reflecting mirror 183, passing through the laser medium 180 and being amplified each time. When the pulsed laser light $LSR_{PLS}$ has been amplified so that the intensity thereof exceeds a unique threshold of the saturable absorber 182, the saturable absorber 182 functions as the passive Q switch to release the pulsed laser light $LSR_{PLS}$ which has a high energy density. Consequently, the pulsed laser light $LSR_{PLS}$ is outputted from the laser resonator 18 via the light exit surface (i.e., the distal-side end face in FIG. 4) of the partially reflecting mirror 183.

The enlarging optical element 15 is made of a well-known optical material such as quartz glass. The enlarging optical element 15 enlarges the beam diameter of the pulsed laser light $LSR_{PLS}$ outputted from the laser resonator 18 so as to make the beam diameter have a predetermined value at a predetermined distance. In addition, by first enlarging the beam diameter of the pulsed laser light $LSR_{PLS}$ via the enlarging optical element 15 and then focusing the beam diameter-enlarged pulsed laser light $LSR_{PLS}$ via the focusing optical element 11, it is possible to increase the energy density of the pulsed laser light $LSR_{PLS}$.

The enlarging optical element 15 includes the enlarging lens 150 for enlarging the beam diameter of the pulsed laser light $LSR_{PLS}$ and the substantially cylindrical enclosure 151 for receiving the enlarging lens 150.

In the present embodiment, as shown in the sub-diagram (a-3) of FIG. 4, the enclosure 151 has a double structure consisting of a male enclosure 151M and a female enclosure 151F. The enclosure 151 receives the enlarging lens 150 therein and is accurately machined so that both the proximal-side end face 154 and the distal-side end face 155 of the enclosure 151 is perpendicular to the optical axis of the enlarging lens 150. The enclosure 151 also has such a positioning function that when the distal-side end face 155 of the enclosure 151 abuts the second reference surface S2, the pulsed laser light $LSR_{PLS}$ can be outputted to the focusing optical element 11 with the beam diameter of the pulsed laser light $LSR_{PLS}$ enlarged by the enlarging lens 150 to the predetermined value.

Referring to the sub-diagram (a-1) of FIG. 4, the introducing optical element 21 and an annular spacer (or elastic member) 22 are first inserted in the inner housing 20 from the proximal-side opening of the inner housing 20. The spacer 22 is made of an elastic metal material such as red brass. Then, the optical fiber connecting member 23 is screwed into the female-threaded portion 201M of the inner housing 20 from the proximal-side opening of the inner housing 20. Consequently, referring to the sub-diagram (b) of FIG. 4, in the inner housing 20, the introducing optical element 21 is elastically pressed against the third reference surface S3 by the optical fiber connecting member 23 via the spacer 22.

Further, the laser resonator 18, the collar 17 and the spring member 16 are inserted in the inner housing 20 from the distal-side opening of the inner housing 20. Then, the enlarging optical element 15 is inserted in the outer housing 10 from the proximal-side opening of the outer housing 10. Thereafter, the inner housing 20, which has the components 16, 17, 18, 21, 22 and 23 received therein, is connected to the outer housing 10 by tightening the male-threaded portion 204 of the inner housing 20 into the female-threaded portion 106F of the outer housing 10 with the O-ring 19 interposed between the outer and inner housings 10 and 20. Consequently, as shown in the sub-diagram (b) of FIG. 4, by the elastic force of the spring member 16, the proximal-side end face of the laser resonator 18 is elastically pressed against the distal-side end face 214 of the introducing optical element 21 that abuts the third reference surface S3 while the distal-side end face 151 of the enlarging optical element 15 is elastically pressed against the second reference surface S2. That is, the proximal-side end face of the laser resonator 18 is brought into contact with the distal-side end face 214 of the introducing optical element 21, while the distal-side end face 151 of the enlarging optical element 15 is brought into contact with the second reference surface S2.

As a result, as shown in FIGS. 1 and 4, in the obtained laser ignition apparatus 1 according to the present embodiment, a predetermined distance (i.e., a predetermined length of the first non-optical element arrangement region L1) is secured between the focusing optical element 11 and the enlarging optical element 15. The focusing optical element 11 is received in the first optical element-receiving space 101 formed in the outer housing 10 so as to be in contact with the first reference surface S1. The enlarging optical element 15 is received in the second optimal element-receiving space 106 formed in the outer housing 10 so as to be in contact with the second reference surface S2. Further, a predetermined distance L2 is secured between the distal-side end face 155 of the enlarging optical element 15 and the introducing optical element 21 (i.e., between the second reference surface S2 and the third reference surface S3). The introducing optical element 21 is received in the third optical element-receiving space 201 formed in the inner housing 20 so as to be in contact with the third reference surface S3.

Furthermore, for the optical elements 11, 15 and 21, the outer side surfaces of the enclosures 111, 151 and 213 are respectively held by the inner surfaces of the optical element-receiving spaces 101, 106 and 201, and the end faces 112, 155 and 214 of the enclosures 111, 151 and 213 are respectively in contact with the reference surfaces S1, S2 and S3. Consequently, the optical axes of the optical elements 11, 15 and 21 are aligned with each other in the axial direction of the outer and inner housings 10 and 20, and the distances between the optical elements 11, 15 and 21 in the axial direction are kept constant.

Moreover, as shown in the sub-diagram (b) of FIG. 4, in the state of the outer and inner housings 10 and 20 being connected together, there is a clearance G provided between the distal-side end of the inner housing 20 and the enlarging optical element 15. With the clearance G, the enlarging optical element 15 is prevented from being subjected to the tightening axial force for tightening the male-threaded portion 204 of the inner housing 20 into the female-threaded portion 106F of the outer housing 10.

In addition, in the present embodiment, the spring member 16 is configured to have a natural frequency that is higher than a vibration frequency caused according to the operating rotational speed of the engine.

More specifically, the spring constant k of the spring member 16 is set so that the frequency of simple harmonic oscillation of a system including the mass of the spring member 16 is higher than the vibration frequency caused according to the operating rotational speed of the engine.

Further, in the present embodiment, the preload kX of the spring member 16 is set so that: kX>MG (N), where X is the amount of pre-displacement of the spring member 16 from its free end, M is the mass in kg imposed on the spring member 16 and G is the vibration acceleration in $m/s^2$ caused by operation of the engine.

Furthermore, in the present embodiment, the following relationships are further specified: f>60N; and $$f > (1/2\pi) \times \sqrt{\left(\frac{k}{M}\right)},$$

where f is the natural frequency in Hz of the spring member 16 and N is the maximum rotational speed in rpm of the engine.

In the present embodiment, the outer and inner housings 10 and 20 are connected together via the mating engagement between the female-threaded portion 106F of the outer housing 10 and the male-threaded portion 204 of the inner housing 20. Moreover, between the inner surface of the inner housing-receiving space 108 formed in the outer housing 10 and the distal-side outer surface 208 of the inner housing 20, there is provided such a small clearance as to allow the two surfaces to be slidable against each other. Further, in the distal-side outer surface 208 of the inner housing 20, there is formed the annular groove 209 in which the O-ring 19 is disposed. The O-ring 19 is made of a heat-resistant elastic material such as a silicone rubber and a fluororubber. With the O-ring 19 interposed between the outer and inner housings 10 and 20, it is possible to ensure the fluid-tightness therebetween.

Next, the detailed configurations of the cooling device 26 and the optical fiber 29 and the manners of mounting the two components 26 and 29 in the laser ignition apparatus 1 will be described with reference to FIGS. 1 and 5.

As shown in FIG. 5, the cooling device 26 has a substantially cylindrical base body 260 that is made of a metal material such as stainless steel. In the inner surface of the base body 260, there is formed an annular groove that makes up the cooling channel 265. The base body 260 also has a pair of through-holes 261 and 262 that are formed through a proximal-side end wall of the base body 260 so as to communicate with the cooling channel 265. End portions 270 and 280 of the inlet and outlet pipes 27 and 28 are respectively inserted in the through-holes 261 and 262 of the base body 260 and fixed therein by means of threaded portions 271 and 281. Consequently, the cooling channel 265 is fluidly connected to the external heat exchanger 60 via the inlet and outlet pipes 27 and 28. In addition, though not shown in the figures, seal members are provided between the base body 260 and the inlet and outlet pipes 27 and 28 so as to ensure fluid-tightness therebetween.

The cooling channel 265 is formed not only by the annular groove 265 shown in FIG. 5, but also by an annular groove (not shown) that is formed in a distal-side inner surface 266 of the base body 260 facing the proximal-side outer surface 109 of the outer housing 10 so as to have a substantially U-shaped cross section and an annular groove (not shown) that is formed in a proximal-side inner surface 263 of the base body 260 facing the proximal-side outer surface 206 of the inner housing 20 so as to have a substantially U-shaped cross section. Consequently, with the above formation of the cooling channel 265, both the proximal-side outer surface 109 of the outer housing 10 and the proximal-side outer surface 206 of the inner housing 20 are directly exposed to the coolant flowing in the coolant channel 265, thereby improving the efficiency of heat exchange between the coolant and the outer and inner housings 10 and 20.

Moreover, as shown in FIG. 5, at the distal ends of the end portions 270 and 280 of the inlet and outlet pipes 27 and 28, there are respectively formed an inlet hole 272 and an outlet hole 282 both of which open to the cooling channel 265.

Between the proximal-side inner surface 263 of the base body 260 and the proximal-side outer surface 206 of the inner housing 20, there is provided such a small clearance as to allow the two surfaces 263 and 206 to be slidable against each other. Further, the clearance between the two surfaces 263 and 206 is sealed by the O-ring 24 that is disposed in the annular groove 207 formed in the proximal-side outer surface 206 of the inner housing 20. Similarly, between the distal-side inner surface 266 of the base body 260 and the proximal-side outer surface 109 of the outer housing 10, there is provided such a small clearance as to allow the two surfaces 266 and 109 to be slidable against each other. Further, the clearance between the two surfaces 266 and 109 is sealed by the O-ring 25 that is disposed in an annular groove 267 formed in the distal-side inner surface 266 of the base body 260.

Consequently, the fluid-tightness between the cooling device 26 and the outer and inner housings 10 and 20 is secured by the O-rings 24 and 25. In addition, as described previously, the fluid-tightness between the outer and inner housings 10 and 20 is secured by the O-ring 19 interposed therebetween.

The cooling device 26 is attached to the outer and inner housings 10 and 20 only by means of the elastic forces of the O-rings 24 and 25. Therefore, the cooling device 26 is detachable from the outer and inner housings 10 and 20. In addition, the attaching and detaching of the cooling device 26 to and from the outer and inner housings 10 and 20 is made by first screwing bolts (not shown) into female-threaded holes 264 formed in the proximal-side end face of the base body 260 of the cooling device 26 and then pushing downward or pulling upward the bolts.

In the present embodiment, the inlet and outlet pipes 27 and 28 are fixed to the base body 260 of the cooling device 26 by thread fastening. However, the inlet and outlet pipes 27 and 28 may also be fixed to the base body 260 by other methods, such as brazing, provided that it is possible to secure the fluid-tightness between the inlet and outlet pipes 27 and 28 and the base body 260.

Moreover, the inlet and outlet pipes 27 and 28 may be connected to the external heat exchanger 60 by any method known in the art, for example by using flexible pipes and pipe joints.

In addition, as shown in FIG. 5, at the distal-side end of the outer periphery of the base body 260, there is formed a guide surface 268 that tapers toward the distal side. With the guide surface 268, the laser ignition apparatus 1 can be easily inserted in the plug hole 441 formed in the cylinder head 440.

The optical fiber connecting member 23 has a substantially cylindrical base body 230, in which is formed an optical fiber-receiving space 231 for receiving the optical fiber 29. On the distal-side outer periphery of the base body 230, there is formed a male-threaded portion 232 for mating with the female-threaded portion 201M of the inner housing 20. On the intermediate outer periphery of the base body 230, there is formed a flange portion 233 for seating on the proximal-side end face of the inner housing 20. On the proximal-side outer periphery of the base body 230, there is formed a male-threaded portion 234 for fixing the optical fiber 29 to the base body 230.

The optical fiber 29 is inserted in the optical fiber-receiving space 231 formed in the optical fiber connecting member 23 from the proximal side of the member 23. The optical fiber 29 is then fixed to the optical fiber connecting member 23 by screwing a cap nut 291 onto the male-threaded portion 234 of the member 23 with a shim ring 290 interposed therebetween. The optical fiber 29 includes a core material 292 and a protective member 293. The protective member 293 covers the core material 292 so that the distal-side end of the core material 292 is exposed from the protective member 293 at a position away form the third reference surface S3 by a predetermined distance L3 (see FIG. 1).

After having described the configuration of the laser ignition apparatus 1 according to the present embodiment, advantages thereof will be described hereinafter.

First, referring to FIG. 6, a first advantage of the laser ignition apparatus 1 will be described in comparison with a first disadvantage of a laser ignition apparatus 1*z* according to a comparative example.

Figure 6:
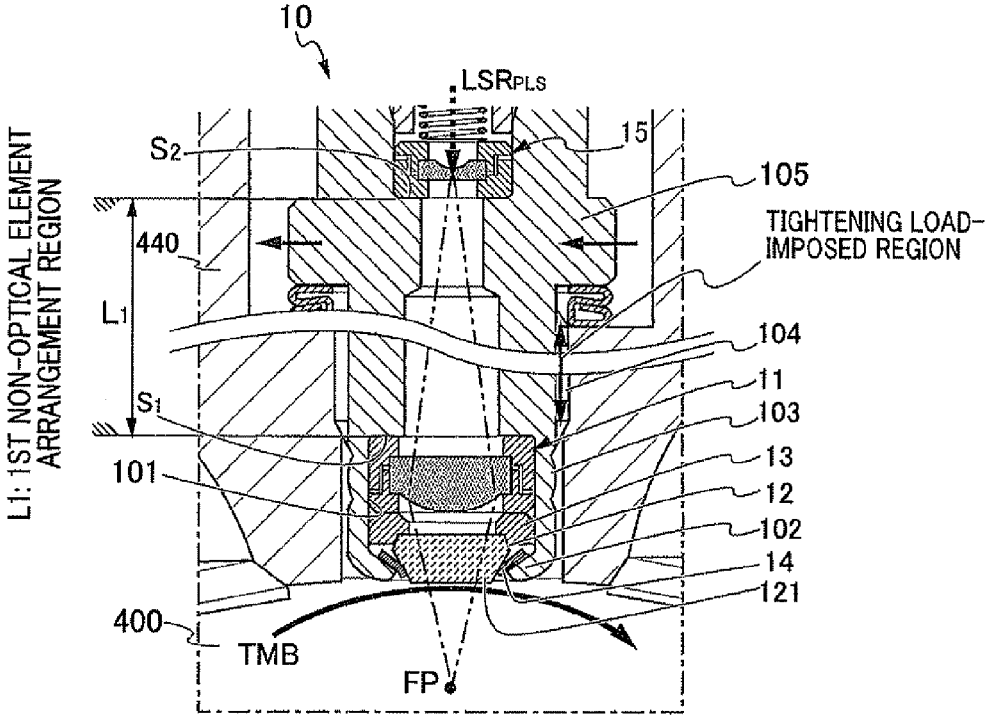
FIG. 6 is a schematic diagram illustrating first and second advantages of the laser ignition apparatus according to the first embodiment in comparison with first and second disadvantages of a laser ignition apparatus according to a comparative example, wherein the sub-diagram (a) is a cross-sectional view showing part of the laser ignition apparatus according to the first embodiment and the sub-diagram (b) is a cross-sectional view showing part of the laser ignition apparatus according to the comparative example.
Figure 6:
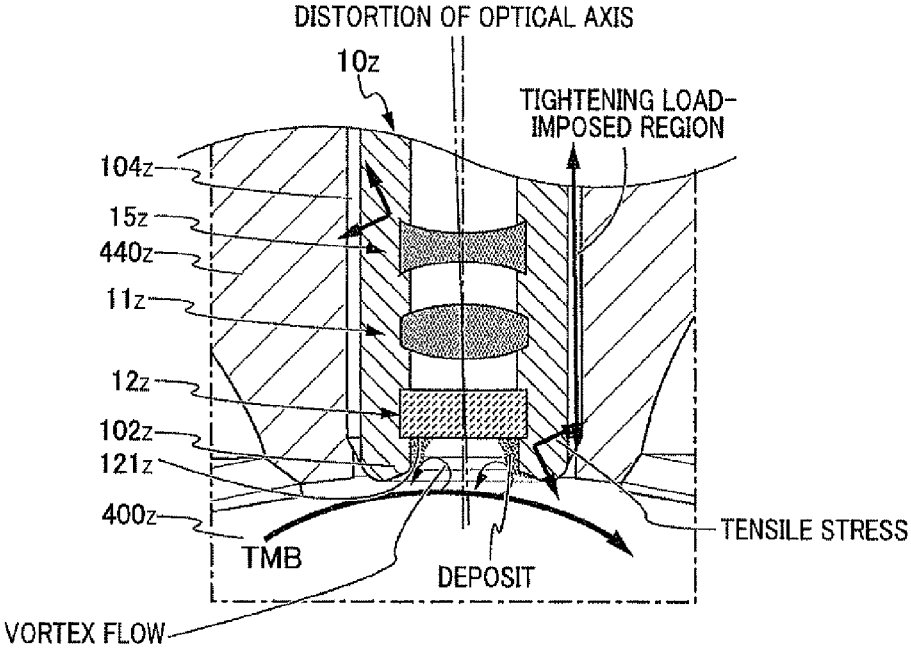

In the laser ignition apparatus 1 according to the present embodiment, as shown in the sub-diagram (a) of FIG. 6, between the distal-side end of the male-threaded portion 104 and the proximal-side end of the hexagonal portion 105 of the outer housing 10, there is provided the first non-optical element arrangement region L1 in which none of the optical elements 11, 15 and 21 is arranged. Further, at the distal-side and proximal-side ends of the first non-optical element arrangement region L1, there are respectively provided the first and second reference surfaces S1 and S2. The focusing optical element 11 is arranged on the distal side of the first non-optical element arrangement region L1 so as to be elastically pressed against the first reference surface S1. The enlarging optical element 15 is arranged on the proximal side of the first non-optical element arrangement region L1 so as to be elastically pressed against the second reference surface S2.

With the above arrangement, when the hexagonal portion 105 of the outer housing 10 is turned for tightening the male-threaded portion 104 of the outer housing 10 into the female-threaded hole 442 of the cylinder head 440, both the tightening axial load imposed on the male-threaded portion 104 and the tightening torque imposed on the hexagonal portion 105 of the outer housing 10 will not be transmitted to the optical elements 11, 15 and 21. Consequently, both distortion of the optical axes of the optical elements 11, 15 and 21 and misalignment between the optical axes of the optical elements 11, 15 and 21 can be prevented from occurring during the fixing of the outer housing 10 to the cylinder head 440.

Further, during the fixing of the outer housing 10 to the cylinder head 440, that part of the outer hosing 10 which is positioned between the first and second reference surfaces S1 and S2 may be twisted by the tightening torque. However, after the fixing of the outer housing 10 to the cylinder head 440, that part of the outer housing 10 will be firmly secured to the cylinder head 440, keeping the predetermined distance between the first and second reference surfaces S1 and S2 (i.e., the predetermined length of the first non-optical element arrangement region L1) unchanged. Accordingly, the predetermined distance between the focusing optical element 11 and the enlarging optical element 15 will also be kept unchanged.

In addition, as described previously, the seat ring 13, which has a larger coefficient of thermal expansion than the outer housing 10, is interposed between the optical window member 12 and the focusing optical element 11. Consequently, when the outer housing 10 is expanded by the heat generated by combustion of the air-fuel mixture in the combustion chamber 400, it is possible to compensate the decrease in the pressing force of the crimped portion 102 due to the thermal expansion of the outer housing 10 with the thermal expansion force of the seat ring 13, thereby keeping the focusing optical element 11 elastically pressed against the first reference surface S1.

As a result, it is possible to allow the enlarging optical element 15 to reliably enlarge the beam diameter of the pulsed laser light $LSR_{PLS}$ to the predetermined value and output the beam diameter-enlarged pulsed laser light $LSR_{PLS}$ to the focusing optical element 11. It is also possible to allow the focusing optical element 11 to reliably focus the beam diameter-enlarged pulsed laser light $LSR_{PLS}$ to the predetermined focal point FP in the combustion chamber 400, thereby ensuring stable ignition of the air-fuel mixture by the pulsed laser light $LSR_{PLS}$.

In comparison, in the laser ignition apparatus 1z according to the comparative example, as shown in the sub-diagram (b) of FIG. 6, both the focusing optical element 11z and the enlarging optical element 15z are axially interposed between the distal-side end of the male-threaded portion 104z and the hexagonal portion 105z (not shown) of the outer housing 10z. Consequently, when the hexagonal portion 105z of the outer housing 10z is turned for tightening the male-threaded portion 104z of the outer housing 10z into the female-threaded hole 442 of the cylinder head 440, both the tightening axial load imposed on the male-threaded portion 104z and the tightening torque imposed on the hexagonal portion 105z of the outer housing 10z may be transmitted to the optical elements 11z and 15z to induce mechanical stresses in the optical elements 11z and 15z. As a result, due to the mechanical stresses, the optical axes of the optical elements 11z and 15z may be distorted, thereby making it difficult to ensure stable ignition of the air-fuel mixture by the pulsed laser light $LSR_{PLS}$.

In addition, the focusing lens of the focusing optical element 11z is formed by combining a plurality of lenses. Therefore, dimensional errors of the lenses may be accumulated, thereby making it impossible for the focusing lens to focus the pulsed laser light $LSR_{PLS}$ to the predetermined focal point FP in the combustion chamber 400.

Next, referring again to FIG. 6, a second advantage of the laser ignition apparatus 1 according to the present embodiment will be described in comparison with a second disadvantage of the laser ignition apparatus 1z according to the comparative example.

In the laser ignition apparatus 1 according to the present embodiment, as shown in the sub-diagram (a) of FIG. 6, the distal-side end face 121 (i.e., the light exit surface) of the optical window member 12 is flush with the distal-side end face of the outer housing 10 (i.e., the distal-side end face of the crimped portion 102 of the outer housing 10). Consequently, when the flow TMB of air/fuel mixture in the combustion chamber 400 passes through the distal-side end face 121 of the optical window member 12, it is possible for the flow TMB to blow off unwanted matter (e.g., unburned fuel or soot) having adhered to the distal-side end face 121, thereby cleaning the distal-side end face 121. As a result, it is possible to prevent the transmittance of the pulsed laser light $LSR_{PLS}$ from being lowered by deposit of the unwanted matter on the distal-side end face 121 of the optical window member 12. It is also possible to prevent the optical axis of the pulsed laser light $LSR_{PLS}$ from being distorted by an abnormal refraction due to deposit of the unwanted matter on the distal-side end face 121.

In comparison, in the laser ignition apparatus 1z according to the comparative example, as shown in the sub-diagram (b) of FIG. 6, the optical window member 12z is substantially flat plate-shaped. Thus, the distal-side end face of the outer housing 10z is positioned on the distal side of the light exit surface 121z of the optical window member 12z, forming a step between the distal-side end face of the outer housing 10z and the light exit surface 121z of the optical window member 12z. Consequently, when the flow TMB of air/fuel mixture in the combustion chamber 400 passes through the light exit surface 121z of the optical window member 12z, a vortex flow may be generated in the vicinity of the step, lowering the speed of the flow TMB and thereby causing the unwanted matter to deposit on the inside of the step. Further, the deposit of the unwanted matter may gradually expand from the outer periphery to the center of the light exit surface 121z of the optical window member 12z, causing the transmittance of the pulsed laser light $LSR_{PLS}$ to be lowered and the optical axis of the pulsed laser light $LSR_{PLS}$ to be distorted. As a result, it may become impossible to ensure stable ignition of the air-fuel mixture by the pulsed laser light $LSR_{PLS}$.

Next, a third advantage of the laser ignition apparatus 1 according to the present embodiment will be described.

Figure 7:
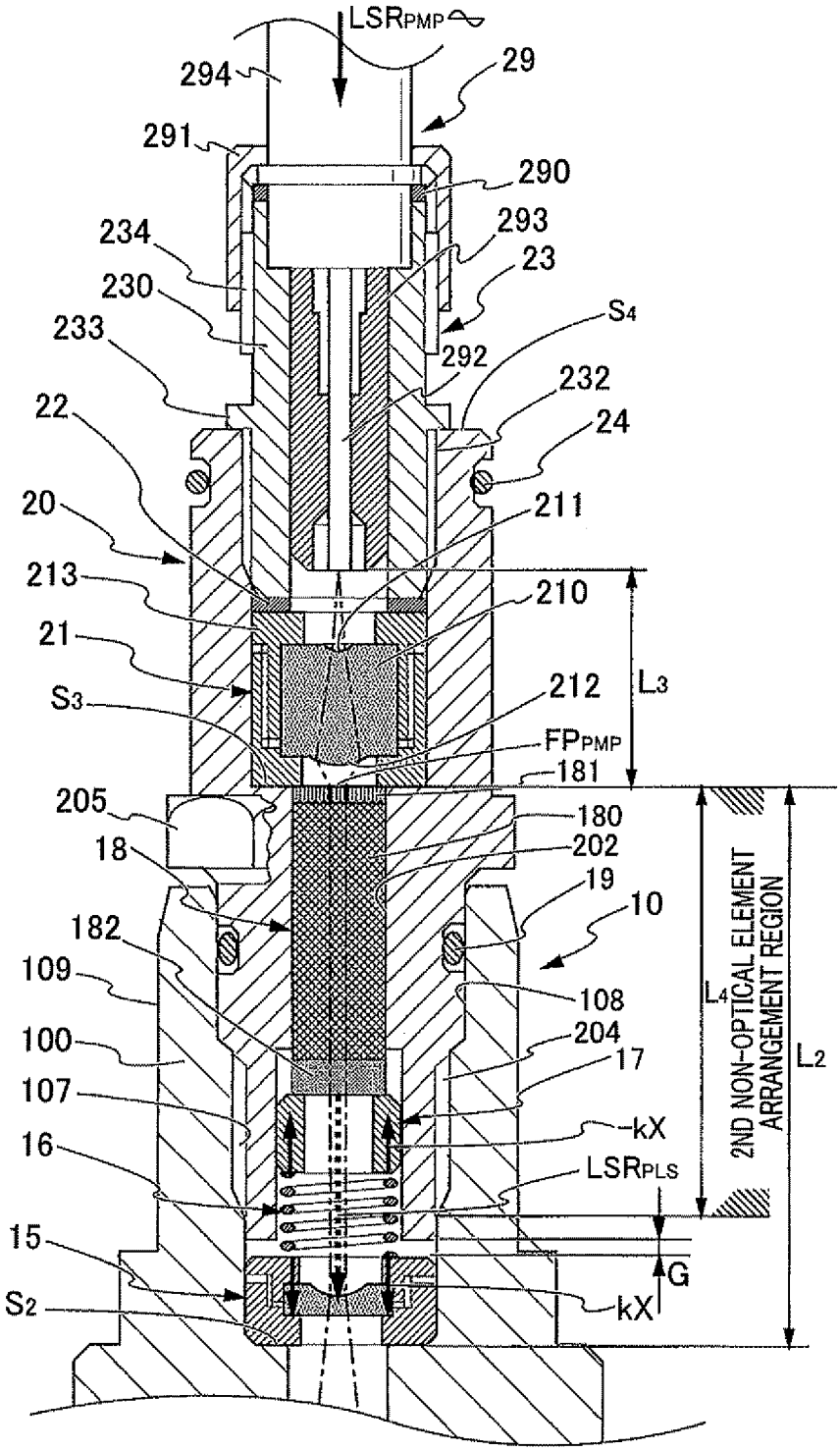
FIG. 7 is an enlarged cross-sectional view of part of the laser ignition apparatus according to the first embodiment, which illustrates third and fourth advantages of the apparatus.

In the laser ignition apparatus 1, as shown in FIG. 7, between the distal-side end of the male-threaded portion 204 and the proximal-side end of the hexagonal portion 205 of the inner housing 20, there is provided the second non-optical element arrangement region L4 in which none of the optical elements 11, 15 and 21 is arranged. Further, at the proximal-side end of the second non-optical element arrangement region L4, there is provided the third reference surface S3. The introducing optical element 21 is received in the third optical element-receiving space 201 that is formed in the inner housing 20 on the proximal side of the third reference surface S3, so that the introducing optical element 21 is elastically pressed against the third reference surface S3 by the optical fiber connecting member 23 via the spacer 22.

With the above arrangement, when the hexagonal portion 205 of the inner housing 20 is turned for tightening the male-threaded portion 204 of the inner housing 20 into the female-threaded portion 106E of the outer housing 10, both the tightening axial load imposed on the male-threaded portion 204 and the tightening torque imposed on the hexagonal portion 205 of the inner housing 20 will not be transmitted to the optical elements 11, 15 and 21. Moreover, during the fixing of the optical fiber connecting member 23 to the inner housing 20, both the tightening axial load and the tightening torque for tightening the male-threaded portion 232 of the optical fiber connecting member 23 into the female-threaded portion 201M of the inner housing 20 will also not be transmitted to the optical elements 11, 15 and 21. Consequently, both distortion of the optical axes of the optical elements 11, 15 and 21 and misalignment between the optical axes of the optical elements 11, 15 and 21 can be prevented from occurring during the fixing of the inner housing 20 to the outer housing 10 as well as from occurring during the fixing of the optical fiber connecting member 23 to the inner housing 20. As a result, it is possible to ensure stable ignition of the air-fuel mixture by the pulsed laser light $LSR_{PLS}$.

Next, a fourth advantage of the laser ignition apparatus 1 according to the present embodiment will be described.

In the laser ignition apparatus 1, as shown in FIG. 7, the proximal-side end face (or the light entrance surface) 181 of the laser resonator 18 is elastically pressed, by the elastic force of the spring member 16, against the distal-side end face 214 of the introducing optical element 21 at the third reference surface S1 Consequently, a variation in the machining accuracy of the laser resonator 18 and a dimensional change of the laser resonator 18 due to the heat generated in the laser resonator 18 can be absorbed by expansion/contraction of the spring member 16, thereby keeping the optical distance between the introducing optical element 21 and the laser resonator 18 constant. Further, with the flange portion 233 of the optical fiber connecting member 23 seating on the proximal-side end face of the inner housing 20 (or on the fourth reference surface S4), the predetermined distance L3 from the distal-side end of the core material 292 of the optical fiber 29 to the proximal-side end face of the laser resonator 18 (or to the third reference surface S3) can also be kept constant. As a result, the beam diameter of the excitation light $LSR_{PMP}$ introduced by the introducing optical element 21 to the proximal-side end face of the laser resonator 18 can be kept constant, thereby ensuring stable output of the pulsed laser light $LSR_{PLS}$ from the laser resonator 18 to the enlarging optical element 15.

In addition, the pulsed laser light $LSR_{PLS}$ is outputted from the laser resonator 18 to the enlarging optical element 15 in the form of a parallel beam. Therefore, output of the beam diameter-enlarged pulsed laser light $LSR_{PLS}$ from the enlarging optical element 15 is not influenced by a dimensional error caused during the assembly of the outer and inner housings 10 and 20 and a dimensional change of the laser resonator 18 due to the heat generated in the laser resonator 18.

Next, a fifth advantage of the laser ignition apparatus 1 according to the present embodiment will be described.

In the laser ignition apparatus 1, as shown in FIG. 7, the laser resonator 18 is received in the resonator-receiving space 202 formed in the inner housing 20. Between the outer surface of the laser resonator 18 and the inner surface of the resonator-receiving space 202, there is provided such a small clearance as to allow the two surfaces to be axially slidable against each other. Consequently, even if there is a difference in coefficient of thermal expansion between the laser resonator 18 and the inner housing 20, it is possible to prevent a thermal stress from being induced in the laser resonator 18 due to the difference, thereby keeping the parallelism between the light entrance and light exit surfaces of the laser resonator 18 unchanged. As a result, it is possible to prevent the optical axis of the pulsed laser light $LSR_{PLS}$ from being distorted during the passing of the pulsed laser light $LSR_{PLS}$ through the laser resonator 18, thereby ensuring stable ignition of the air-fuel mixture by the pulsed laser light $LSR_{PLS}$.

Next, a sixth advantage of the laser ignition apparatus 1 according to the present embodiment will be described.

In the case where the difference in coefficient of thermal expansion between the laser resonator 18 and the inner housing 20 is large, when the beam diameter-regulated excitation light $LSR_{PMP}$ is introduced by the introducing optical element 21 to the laser resonator 18 and thereby causes the temperature of the laser resonator 18 to increase, it may become difficult for the outer surface of the laser resonator 18 to slide against the inner surface of the resonator-receiving space 202 formed in the inner housing 20. Consequently, it may become difficult to prevent the optical axis of the pulsed laser light $LSR_{PLS}$ from being distorted due to a thermal stress induced in the laser resonator 18. Moreover, with increase in the temperature of the laser medium 180, the cycle of the pulsed laser light $LSR_{PLS}$ generated by the laser resonator 18 may be increased, thereby decreasing the number of laser pulses used for each ignition and thus making the ignition of the air-fuel mixture in the combustion chamber 400 unstable.

Figure 8:
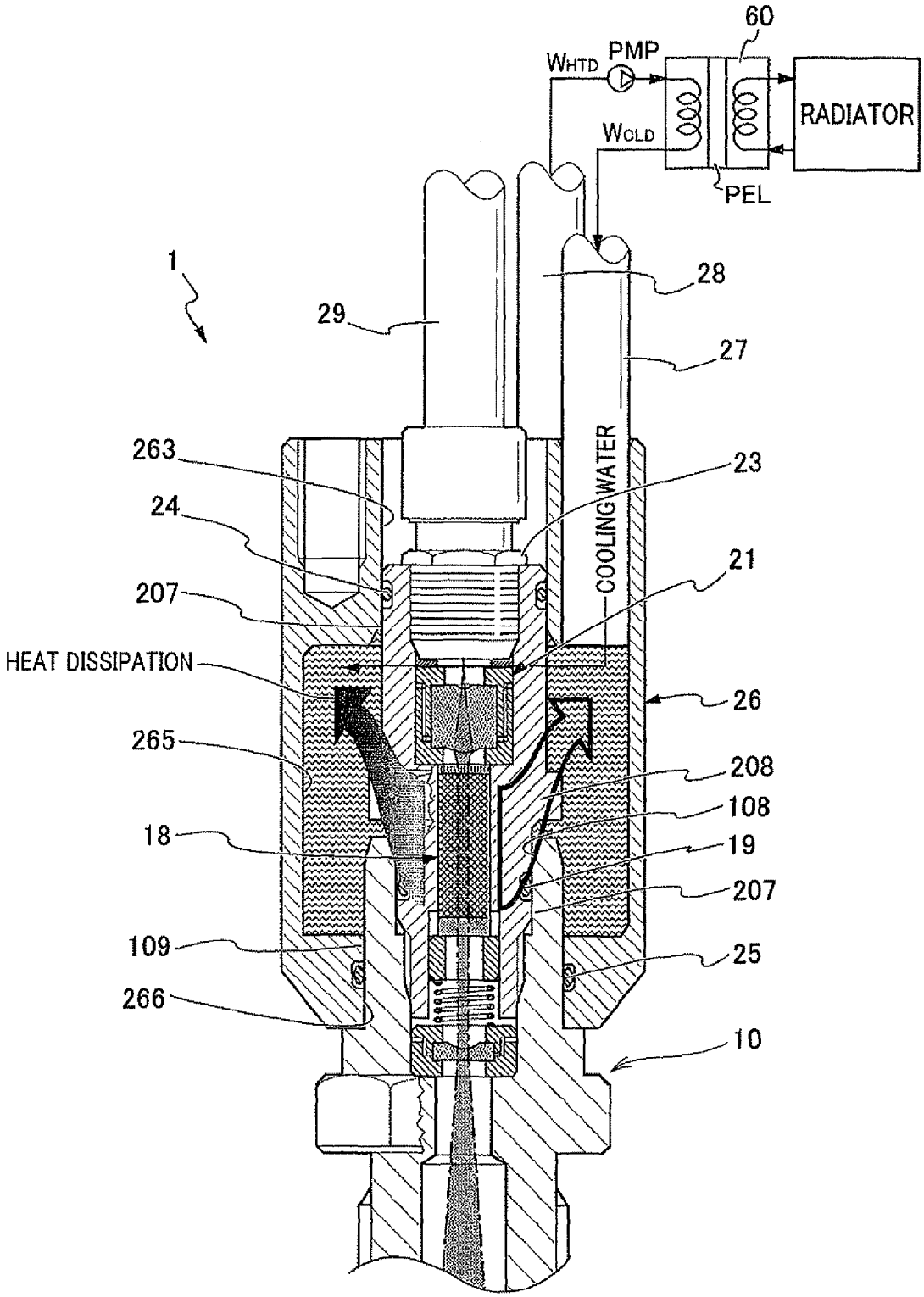
FIG. 8 is an enlarged cross-sectional view of part of the laser ignition apparatus according to the first embodiment, which illustrates a sixth advantage of the apparatus.

However, in the laser ignition apparatus 1 according to the present embodiment, as shown in FIG. 8, the cooling channel 265 formed in the cooling device 26 surrounds both the outer peripheries of the third optical element-receiving space 201 and resonator-receiving space 202 formed in the inner housing 20. Consequently, with the coolant circulating through the coolant channel 265, the temperature of the laser resonator 18 received in the resonator-receiving space 202 can be kept not higher than 40° C. As a result, it is possible to prevent the optical axis of the pulsed laser light $LSR_{PLS}$ from being distorted due to a thermal stress induced in the laser resonator 18 by the difference in coefficient of thermal expansion between the laser resonator 18 and the inner housing 20. It is also possible to suppress increase in the temperature of the laser medium 180, thereby suppressing increase in the cycle of the pulsed laser light $LSR_{PLS}$ to ensure more stable ignition of the air-fuel mixture by the pulsed laser light $LSR_{PLS}$.

In addition, in laser ignition apparatus 1 according to the present embodiment, the cooling device 26 is arranged on the proximal side of the laser resonator 18 as well as on the radially outer side of the laser resonator 18. Consequently, it is possible to effectively dissipate the heat generated in the laser resonator 18 to its proximal side according to the natural law of heat transfer.

Second Embodiment

This embodiment illustrates a laser ignition apparatus 1*a* which has almost the same structure as the laser ignition apparatus 1 according to the first embodiment. Accordingly, only the differences therebetween will be described hereinafter.

In the first embodiment, as described previously, the crimped portion 102 and the heat-deformed portion 103 are each formed as an integral part of the outer housing 10; the optical window member 12 is fixed to the outer housing 10 by the pressing force of the crimped portion 102 (see FIGS. 1-3).

Figure 9:
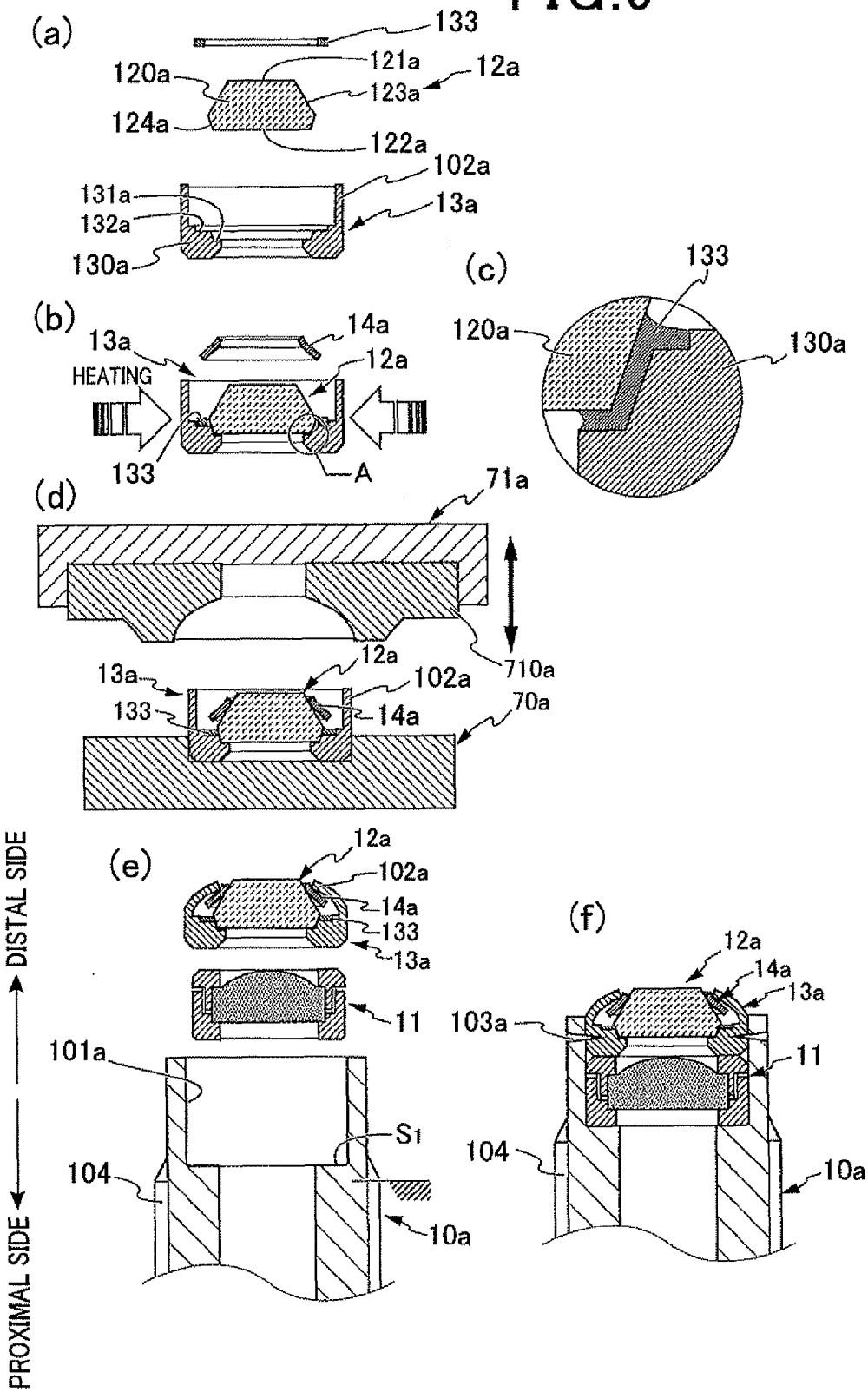
FIG. 9 is a schematic diagram illustrating the manner of fixing an optical window member in a laser ignition apparatus according to a second embodiment.

In comparison, in the present embodiment, as shown in FIG. 9, a crimped portion 102*a* is formed as an integral part of a seat ring (or elastic member) 13*a*. The crimped portion 102*a* wraps and presses the distal-side side surface 123*a* of the optical window member 12*a* via a substantially annular plate (or elastic member) 14*a* so that a component of the pressing force of the crimped portion 102*a* acts on the distal-side side surface 123*a* in the axial direction toward the proximal side. Further, the optical window member 12*a* and the seat ring 13*a* are fixed together by brazing. The seat ring 13*a* is separately formed from the outer housing 10*a* and welded to the outer housing 10*a* with a weld 103*a* formed between the seat ring 13*a* and a distal-side end portion of the outer housing 10*a*.

The seat ring 13*a* is made of a metal material having a larger coefficient of thermal expansion than the outer housing 10*a*. In addition, it should be noted that in FIG. 9, the upper and lower sides respectively correspond to the distal and proximal sides.

Specifically, as shown in the sub-diagram (a) of FIG. 9, the seat ring 13*a* is substantially cylindrical in shape and has a tapered inner surface 131*a* conforming to the proximal-side side surface 124*a* of the optical window member 12*a*. Further, in the inner periphery of the seat ring 13*a* on the distal side of the tapered inner surface 131*a*, there is formed an annular groove 132*a* for placing a brazing material 133 thereon. Moreover, the seat ring 13*a* has a thin-wall portion on the distal side of the annular groove 132*a*. The crimped portion 102*a* is formed by performing a crimping process on the thin-wall portion.

In a first step of the crimping process, as shown in the sub-diagram (b) of FIG. 9, both the optical window member 12*a* and the brazing material 133 are mounted to the seat ring 13*a*. Then, the seat ring 13*a* is heated from the radially outer side thereof.

Consequently, as shown in the sub-diagram (c) of FIG. 9, the brazing material 133 is melted and distributed between the optical window member 12*a* and the seat ring 13*a*, and then cooled to join the two components 12*a* and 13*a* together.

In a second step of the crimping process, as shown in the sub-diagram (d) of FIG. 9, the seat ring 13*a*, which has the optical window member 12*a* mounted thereto, is fixed to a fixing die 70*a*. Then, the plate 14*a* is placed on the distal-side side surface 123*a* of the optical window member 12. Thereafter, a crimping die 710*a*, which has a substantially cup-shaped recess formed in the lower surface thereof, is moved downward by a vertical moving device 71*a* to press the thin-wall portion of the seat ring 13*a*.

Consequently, the thin-wall portion of the seat ring 13*a* is buckled radially inward and thereby brought into pressed contact with the plate 14*a*. As a result, the crimped portion 102*a* is obtained which wraps and presses the distal-side side surface 123*a* of the optical window member 12*a* via the plate 14*a*.

After forming the crimped portion 102*a* as above, the focusing optical element 11 and the seat ring 13*a* together with the optical window member 12*a* are placed in the first optical element-receiving space 101*a* formed in the outer housing 10*a*, as shown in the sub-diagram (e) of FIG. 9. Then, the distal-side end portion of the outer housing 10*a* and the seat ring 13*a* are laser-welded together to form the weld 103*a* therebetween. As a result, the laser ignition apparatus 1*a* according to the present embodiment is obtained.

The above-described laser ignition apparatus 1*a* according to the present embodiment has the same advantages as the laser ignition apparatus 1 according to the first embodiment.

While the above particular embodiments have been shown and described, it will be understood by those skilled in the art that various modifications, changes, and improvements may be made without departing from the spirit of the invention.

Figure 10:
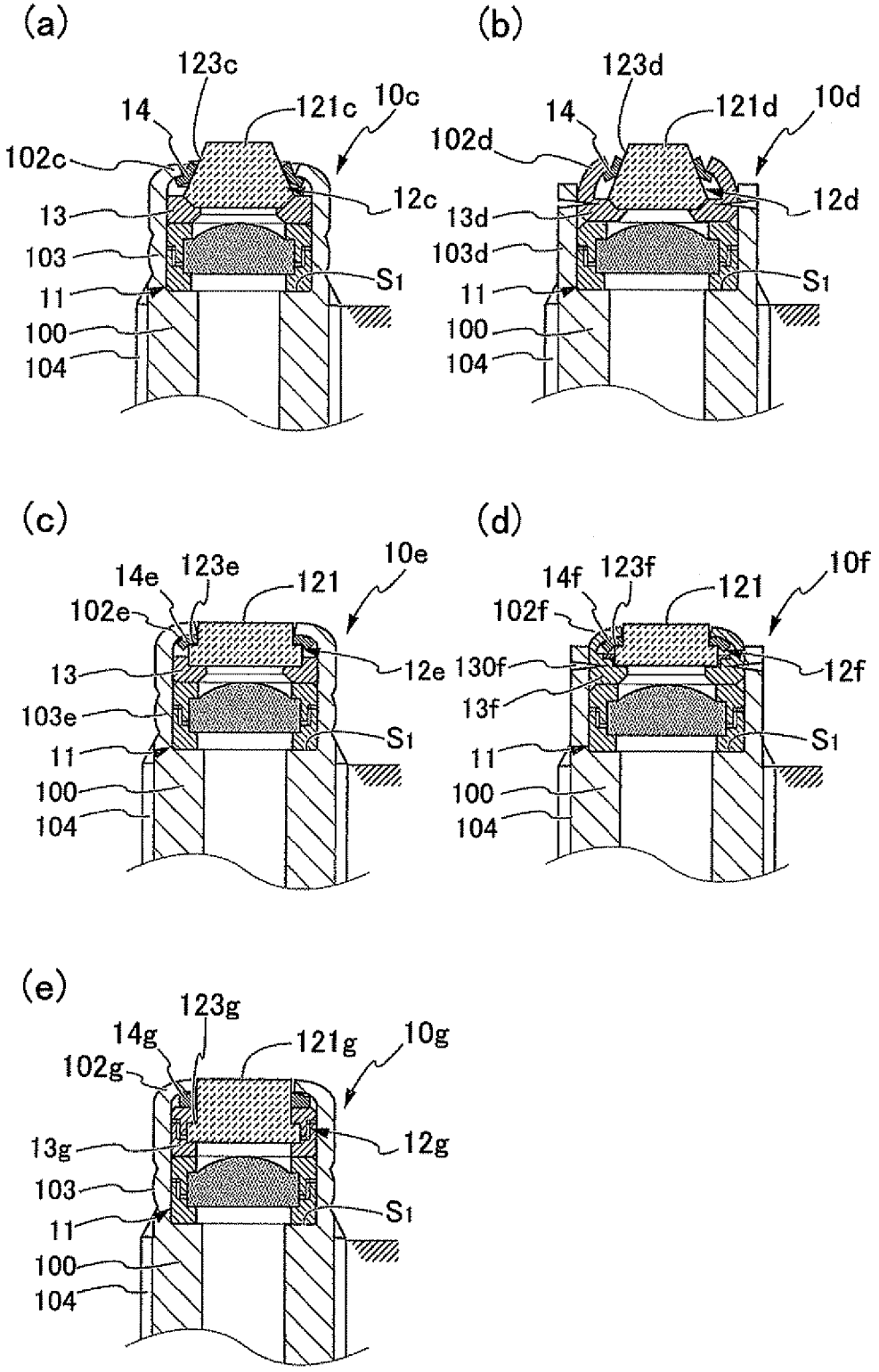
FIG. 10 is a schematic diagram illustrating optical window members and manners of fixing them according to modifications of the first and second embodiments.

For example, FIG. 10 illustrates various modifications of the first and second embodiments.

In the first embodiment, as described previously, the distal-side end face 121 of the optical window member 12 is flush with the distal-side end face of the outer housing 10 (see FIG. 1).

In comparison, in one modification of the first embodiment, as shown in the sub-diagram (a) of FIG. 10, the distal-side end face 121*c* (i.e., the light exit surface) of the optical window member 12*c* is located more distal than the distal-side end face of the outer housing 10*c* (i.e., the distal-side end face of the crimped portion 102*c* of the outer housing 10*c*). In other words, the distal-side end face 121*c* of the optical window member 12*c* protrudes from the distal-side end face of the outer housing 10*e* toward the combustion chamber 400.

With the above location of the distal-side end face 121*c* of the optical window member 12*c* according to the modification, it becomes easier for the flow TMB of air/fuel mixture in the combustion chamber 400 to blow off the unwanted matter (e.g., unburned fuel or soot) which has adhered to the distal-side end face 121*c*. Consequently, the capability of the laser ignition apparatus 1*c* to self-clean the distal-side end face 121*c* of the optical window member 12*c* is improved. In addition, even if the unwanted matter comes to deposit at the boundary between the optical window member 12*c* and the outer housing 10*c*, it is still possible to keep the distal-side end face 121*c* of the optical window member 12*c* free from the deposit of the unwanted matter since the distal-side end face 121*c* is located more distal than the boundary.

Similarly, in one modification of the second embodiment, as shown in the sub-diagram (b) of FIG. 10, the distal-side end face 121*d* of the optical window member 12*d* is located more distal than the distal-side end face of the seat ring 13*d* as well as than the distal-side end face of the outer housing 10*d*.

With the above location of the distal-side end face 121*d* of the optical window member 12*d*, it is possible to achieve the same advantageous effects as with that of the distal-side end face 121*c* of the optical window member 12*c* in the modification shown in the sub-diagram (a) of FIG. 10.

In the first and second embodiments, as described previously, the distal-side side surface 123 (or 123*a*) of the optical window member 12 (or 12*a*) tapers toward the distal side so that the diameter of the distal-side side surface 123 (or 123*a*) continuously decreases in the axial direction toward the distal side. Further, the optical window member 12 (or 12*a*) is fixed by means of the crimped portion 102 (or 102*a*) and the heat-deformed portion 103 (or weld 103*a*) (see FIGS. 1 and 9).

In comparison, in another modification of the first embodiment, as shown in the sub-diagram (c) of FIG. 10, the whole side surface 123*e* of the optical window member 12*e* is stepped to include a small-diameter portion on the distal side and a large-diameter portion on the proximal side; the diameter of the large-diameter portion is larger than that of the small-diameter portion. Further, the optical window member 12*e* is fixed by means of the crimped portion 102*e* and the heat-deformed portion 103*e*.

With the above configuration of the side surface 123*e* of the optical window member 12*e*, it is possible to achieve the same advantageous effects as with that of the side surface 123 of the optical window member 12 according to the first embodiment.

Similarly, in another modification of the second embodiment, as shown in the sub-diagram (d) of FIG. 10, the whole side surface 123*f* of the optical window member 12*f* is stepped to include a small-diameter portion on the distal side and a large-diameter portion on the proximal side; the diameter of the large-diameter portion is larger than that of the small-diameter portion. Further, the optical window member 12*f* is fixed by means of the crimped portion 102*f* and the weld 103*f*.

With the above configuration of the side surface 123*f* of the optical window member 12*f*, it is possible to achieve the same advantageous effects as with that of the side surface 123*a* of the optical window member 12*a* according to the second embodiment.

Moreover, in a further modification of the first and second embodiments, as shown in the sub-diagram (e) of FIG. 10, the seat ring 13 (or 13*a*) is omitted. Instead, the optical window member 12*g* is fixed using a substantially cylindrical enclosure 13*g*. The whole side surface 123*g* of the optical window member 12*g* is stepped to include a small-diameter portion on the distal side and a large-diameter portion on the proximal side; the diameter of the large-diameter portion is larger than that of the small-diameter portion. The enclosure 13*g* has a similar structure to the enclosure 111 of the focusing optical element 11. The optical window member 12*g* is partially received in the enclosure 13*g* so that the large-diameter portion is retained in the enclosure 13*g* while a distal part of the small-diameter portion protrudes outside of the enclosure 13*g*. The crimped portion 102*g* wraps and presses the distal-side end face of the enclosure 13*g* via the plate 14*g* interposed therebetween, thereby fixing the optical window member 12*g* together with the focusing optical element 11 in the first optical element-receiving space 101*g* formed in the outer housing 10*g*.

With the above arrangement of the optical window member 12*g*, it is possible to achieve the same advantages as with those of the optical window members 12 and 12*a* according to the first and second embodiments.

In addition, the frustoconical shapes of the side surfaces 123, 123*a*, 123*c* and 123*d* of the optical window members 12, 12*a*, 12*c* and 12*d* respectively shown in FIGS. 1 and 9 and the sub-diagrams (a)-(b) of FIG. 10 are more preferable than the stepped shapes of the side surfaces 123*e*-123*g* of the optical window members 12*e*-12*g* respectively shown in the sub-diagrams (c)-(e) of FIG. 10 in terms of: (1) facilitating the machining of the optical window members; and (2) preventing stress concentration from occurring in the optical window members during the crimping process or during use of the laser ignition apparatuses.

In the first embodiment, the cooling channel 265 formed in the cooling device 26 surrounds both the outer periphery of the third optical element-receiving space 201 formed in the inner housing 20 for receiving the introducing optical element 21 and the outer periphery of the resonator-receiving space 202 formed in the inner housing 20 for receiving the laser resonator 18 (see FIGS. 1 and 8).

Figure 11:
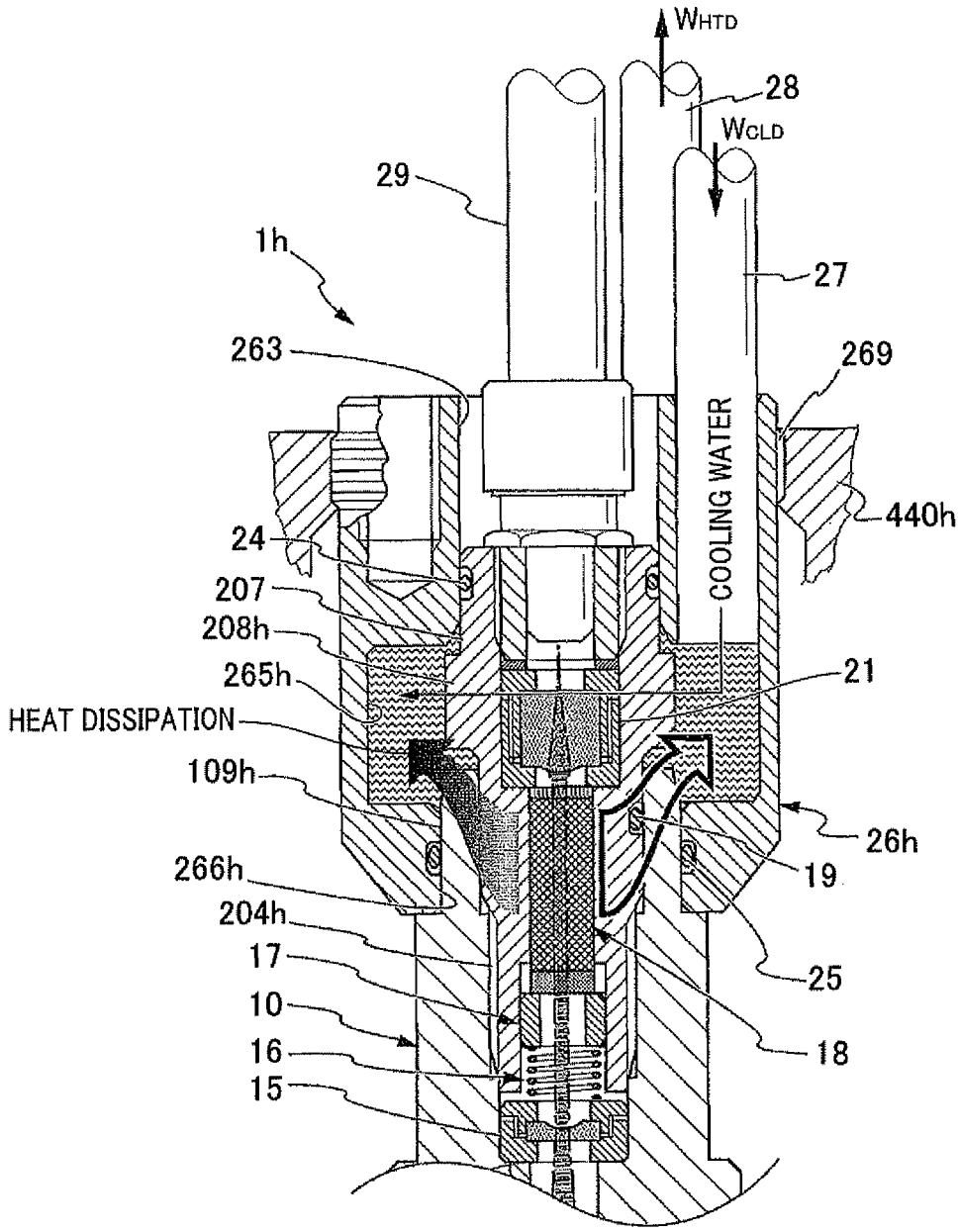
FIG. 11 is a schematic cross-sectional view illustrating the configuration of a cooling device according to a modification of the first embodiment.

In comparison, in yet another modification of the first embodiment, as shown in FIG. 11, the cooling channel 265*h* formed in the cooling device 26*h* surrounds only the outer periphery of the third optical element-receiving space 201 formed in the inner housing 20 for receiving the introducing optical element 21. In other words, the cooling channel 265*h* is configured to surround the outer periphery of the inner housing 20 only on the proximal side of the laser resonator 18.

With the above configuration, it is possible to minimize the size of the cooling device 26*h* while ensuring effective dissipation of the heat generated in the laser resonator 18. It is also possible to minimize the moment of inertia loaded on the outer and inner housings 10 and 20, thereby more reliably preventing distortion the optical axes of the optical elements 11, 15 and 21 received in the outer and inner housings 10 and 20.

In addition, as shown in FIG. 11, it is also possible to provide a male-threaded portion 269 on the proximal-side outer periphery of the cooling device 26*h*, thereby thread-fastening the cooling device 26*h* to the cylinder head 440*h*. Consequently, it is possible to more reliably prevent the cooling device 26*h* from being detached from the outer and inner housings 10 and 20 during operation.

In the first embodiment, the optical fiber connecting member 23 for connecting the optical fiber 29 to the inner housing 20 is fixed to the inner housing 20 by tightening the male-threaded portion 232 of the optical fiber connecting member 23 into the female-threaded portion 201M of the inner housing 20.

However, provided that it is possible to keep a predetermined distance from the distal-side end of the core material 292 of the optical fiber 29 to the enlarging optical element 21 without causing distortion of the optical axis of the element 21, the optical fiber connecting member 23 may also be fixed to the inner housing 20 by other fixing methods, such as press-fitting the member 23 into a proximal-side end portion of the inner housing 20 or inserting the member 23 into the proximal-side end portion of the inner housing 20 and then welding or brazing them together.

What is claimed is:

1. A laser ignition apparatus comprising:

an excitation light source configured to output an excitation light;

an introducing optical element configured to regulate the beam diameter of the excitation light outputted from the excitation light source to a predetermined value;

a laser resonator configured to generate, upon introduction of the beam diameter-regulated excitation light thereto by the introducing optical element, a pulsed laser light and output the generated pulsed laser light;

an enlarging optical element configured to enlarge the beam diameter of the pulsed laser light outputted from the laser resonator and output the beam diameter-enlarged pulsed laser light;

a focusing optical element configured to focus the beam diameter-enlarged pulsed laser light outputted from the enlarging optical element to a predetermined focal point in a combustion chamber of an engine, thereby igniting an air-fuel mixture in the combustion chamber;

an optical window member provided on a combustion chamber side of the focusing optical element to protect the focusing optical element; and a substantially cylindrical housing that receives therein the introducing optical element, the laser resonator, the enlarging optical element, the focusing optical element and the optical window member, wherein the housing has a male-threaded portion for fixing the housing and a hexagonal portion for tightening the male-threaded portion, between a combustion chamber-side end of the male-threaded portion and an anti-combustion chamber-side end of the hexagonal portion, there is defined a non-optical element arrangement region in which none of the introducing optical element, the enlarging optical element and the focusing optical element is arranged, and at one of a combustion chamber-side end and an anti-combustion chamber-side end of the non-optical element arrangement region, there is formed a reference surface that extends perpendicular to an axial direction of the housing, and one of the introducing optical element, the enlarging optical element and the focusing optical element is received in the housing in such a manner as to be elastically pressed against the reference surface from outside of the non-optical element arrangement region.

2. The laser ignition apparatus as set forth in claim 1, wherein the male-threaded portion is a first male-threaded portion, the hexagonal portion is a first hexagonal portion, and the non-optical element arrangement region is a first non-optical element arrangement region, and the reference surface is a first reference surface, the housing has a double structure consisting of an outer housing and an inner housing that is partially received in the outer housing, both the outer and inner housings being substantially cylindrical in shape, the first male-threaded portion is formed on an outer periphery of the outer housing for fixing the outer housing to a cylinder head of the engine, the first hexagonal portion is also formed on the outer periphery of the outer housing for tightening the first male-threaded portion into a female-threaded hole formed in the cylinder head, the first hexagonal portion being positioned on the anti-combustion chamber side of the first male-threaded portion, the first non-optical element arrangement region is defined between the combustion chamber-side end of the first male-threaded portion and the anti-combustion chamber-side end of the first hexagonal portion, a second male-threaded portion is formed on an outer periphery of the inner housing for fixing the inner housing to the outer housing, the second male-threaded portion being positioned on the anti-combustion chamber side of the first hexagonal portion, a second hexagonal portion is also formed on the outer periphery of the inner housing for tightening the second male-threaded portion into a female-threaded portion formed in the outer housing, the second hexagonal portion being positioned on the anti-combustion chamber side of the second male-threaded portion, between a combustion chamber-side end of the second male-threaded portion and an anti-combustion chamber-side end of the second hexagonal portion, there is defined a second non-optical element arrangement region in which none of the introducing optical element, the enlarging optical element and the focusing optical element is arranged, at the combustion chamber-side end of the first non-optical element arrangement region, there is provided the first reference surface, on the combustion chamber side of the first reference surface, there is formed in the outer housing a first optical element-receiving space, in which the focusing optical element is received so as to be elastically pressed against the first reference surface, at the anti-combustion chamber-side end of the first non-optical element arrangement region, there is provided a second reference surface that extends perpendicular to the axial direction of the housing, on the anti-combustion chamber side of the second reference surface, there is formed in the outer housing a second optical element-receiving space, in which the enlarging optical element is received so as to be elastically pressed against the second reference surface, at the anti-combustion chamber-side end of the second non-optical element arrangement region, there is provided a third reference surface that extends perpendicular to the axial direction of the housing, on the anti-combustion chamber side of the third reference surface, there is formed in the inner housing a third optical element-receiving space, in which the introducing optical element is received so as to be elastically pressed against the third reference surface, within the second non-optical element arrangement region, there is formed in the inner housing a resonator-receiving space, in which the laser resonator is axially slidably received, and an elastic member is interposed between the laser resonator and the enlarging optical element so as to elastically press an anti-combustion chamber-side end face of the laser resonator against a combustion chamber-side end face of the introducing optical element and elastically press a combustion chamber-side end face of the enlarging optical element against the second reference surface.

3. The laser ignition apparatus as set forth in claim 1, wherein the optical window member is received in the housing so that a combustion chamber-side end face of the optical window member is flush with a combustion chamber-side end face of the housing.

4. The laser ignition apparatus as set forth in claim 1, wherein the optical window member is received in the housing so that a combustion chamber-side end face of the optical window member protrudes from a combustion chamber-side end face of the housing toward the combustion chamber.

5. The laser ignition apparatus as set forth in claim 1, wherein the reference surface is formed at the combustion chamber-side end of the non-optical element arrangement region, the focusing optical element is received in the housing so as to be positioned on the combustion chamber side of the reference surface, the laser ignition apparatus further comprises means for elastically pressing the focusing optical element against the reference surface, and the elastically pressing means warps and presses a side surface of the optical window member, with the focusing optical element axially interposed between the optical window member and the reference surface, so that a component of the pressing force of the means acts on the side surface of the optical window member in the axial direction away from the combustion chamber.

6. The laser ignition apparatus as set forth in claim 5, wherein the elastically pressing means is made up of a crimped portion formed in the housing at the combustion chamber-side end of the housing.

7. The laser ignition apparatus as set forth in claim 5, wherein between the optical window member and the focusing optical element, there is interposed a substantially cylindrical elastic member that has a higher coefficient of thermal expansion than the housing, and the elastically pressing means is made up of a crimped portion formed in the elastic member at the combustion chamber-side end of the elastic member.

8. The laser ignition apparatus as set forth in claim 5, wherein the side surface of the optical window member has a frustoconical shape tapering toward the combustion chamber.

9. The laser ignition apparatus as set forth in claim 5, wherein the side surface of the optical window member is stepped to include a small-diameter portion on the combustion chamber side and a large-diameter portion on the anti-combustion chamber side, the large-diameter portion having a larger diameter than the small-diameter portion.

10. The laser ignition apparatus as set forth in claim 5, wherein the housing has a heat-deformed portion axially positioned between the reference surface and the elastically pressing means, and the heat-deformed portion is formed by axially pressing a thin-wall portion of the housing while heating the thin-wall portion to permanently deform it, the thin-wall portion being provided between the reference surface and the elastically pressing means and having a smaller wall thickness than other portions of the housing.

11. The laser ignition apparatus as set forth in claim 1, wherein a substantially annular elastic member is axially interposed between the optical window member and the focusing optical element, so that an outer surface of the elastic member abuts an inner surface of the housing and an inner surface of the elastic member abuts a side surface of the optical window member, the elastic member is made of a material having a larger coefficient of thermal expansion than the housing, and the abutting pair of the inner surface of the elastic member and the side surface of the optical window member both taper in the axial direction away from the combustion chamber.

12. The laser ignition apparatus as set forth in claim 1, further comprising a cooling device that is made of a material having a higher heat conductivity than the housing, wherein in the cooling device, there is formed a cooling channel so as to surround an outer periphery of the housing at least on the anti-combustion chamber side of the laser resonator.

13. The laser ignition apparatus as set forth in claim 12, wherein the cooling device is detachably attached to the housing only by means of elastic forces of first and second O-rings that are both made of an elastic material and respectively interposed between an anti-combustion chamber-side inner surface of the cooling device and an outer surface of the housing and between a combustion chamber-side inner surface of the cooling device and the outer surface of the housing.

14. The laser ignition apparatus as set forth in claim 12, wherein the cooling device is configured so that a coolant cooled by an external heat exchanger flows into the cooling channel, is heated while passing through the cooling channel and flows out of the cooling channel to the external heat exchanger.

15. The laser ignition apparatus as set forth in claim 1, wherein the excitation source is located outside of the housing, and the excitation light outputted from the excitation light source is transmitted to the introducing optical element via an optical fiber.

16. The laser ignition apparatus as set forth in claim 1, wherein each of the introducing optical element, the enlarging optical element and the focusing optical element includes an optical lens and a substantially cylindrical enclosure that retains the optical lens therein, the optical lens is configured to receive a light that has a given angle of incidence and output a light that has a given angle of emergence, and the enclosure has both end faces thereof perpendicular to its longitudinal axis, so as to position a focal point of the optical lens with respect to the reference surface.

* * * * *